United States Patent [19]

Gariboldi et al.

[11] Patent Number: 5,020,340

[45] Date of Patent: Jun. 4, 1991

[54] CIRCULAR TEXTILE MACHINE FOR SIMULTANEOUSLY FORMING A PLURALITY OF TUBULAR KNITTED ARTICLES SUCH AS PANTY-HOSE (TIGHTS) AND THE LIKE

[75] Inventors: Franco Gariboldi, Torino; Paolo Conti, Firenze, both of Italy

[73] Assignee: Lambda S.r.l., Firenze, Italy

[21] Appl. No.: 488,731

[22] Filed: Mar. 5, 1990

[30] Foreign Application Priority Data

Mar. 7, 1989 [IT] Italy ..... 9357 A/89

[51] Int. Cl.[5] ..... D04B 9/38

[52] U.S. Cl. ..... 66/125; 66/27; 66/30; 66/104; 66/131; 66/135

[58] Field of Search ..... 66/125, 131, 135

[56] References Cited

U.S. PATENT DOCUMENTS

| | | | |
|---|---|---|---|
| 2,669,104 | 2/1954 | Belford | 66/135 |
| 2,721,460 | 10/1955 | Lombardi | 66/135 |
| 2,754,669 | 7/1956 | Lombardi | 66/135 |
| 3,530,688 | 9/1970 | Lombardi | 66/135 |
| 3,557,577 | 1/1971 | Plath | 66/131 X |
| 3,995,455 | 12/1976 | Hayashi et al. | 66/135 |
| 4,689,971 | 9/1987 | Conti et al. | 66/25 |
| 4,724,687 | 2/1988 | Gariboldi et al. | 66/125 R |

*Primary Examiner*—Werner H. Schroeder
*Assistant Examiner*—John J. Calvert
*Attorney, Agent, or Firm*—McGlew & Tuttle

[57] ABSTRACT

The articles are formed on individual arcs of needles (13, 15) facing each other on the two bars of the cylinder (11) and of the plate (10), the articles having rows formed partly by the needles of one bar and partly by the needles of the other bar, and having two successive yarn feeds (344, 345); means for guiding and switching (458, 459) the position of the two yarns supply them to the needles at two angles and exchange their positions at each reversal of the entrainment thereof by the selective entraining means comprising pairs of hooks (342, 343; 349, 350) carried by two counter-rotating apparatuses (26; 32).

18 Claims, 26 Drawing Sheets

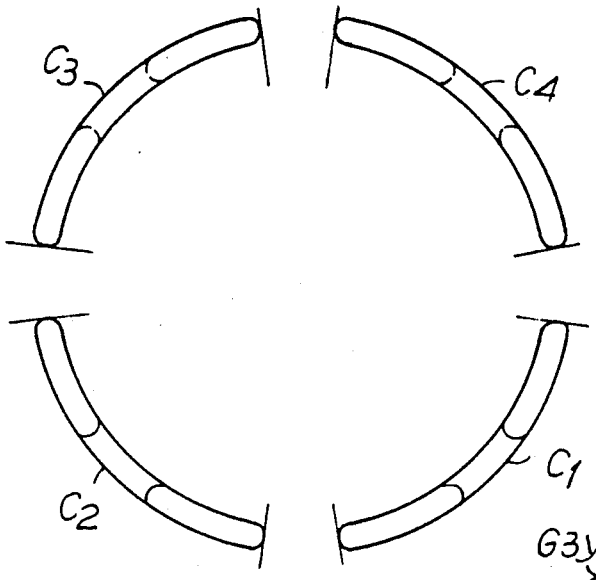
Fig. 2
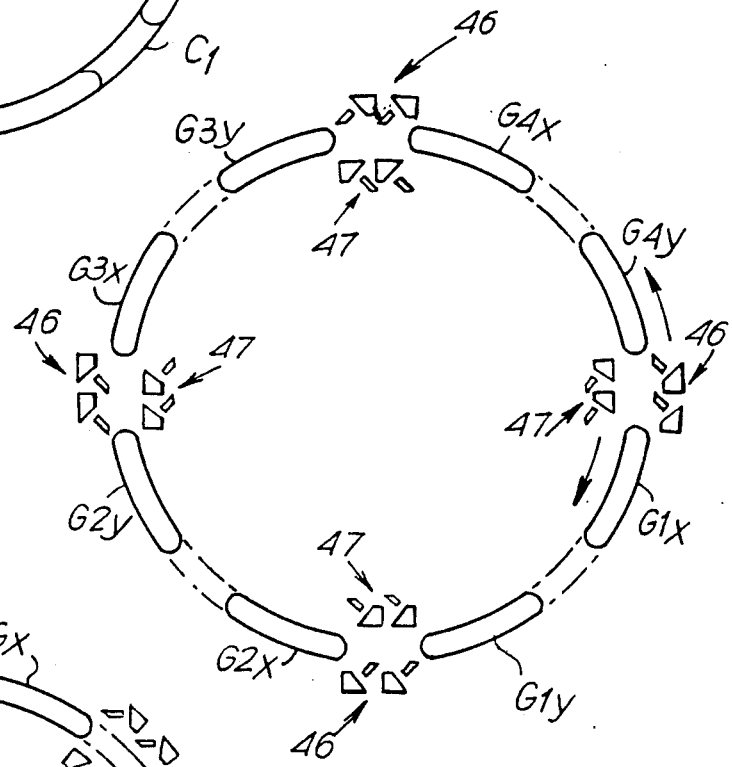
Fig. 3
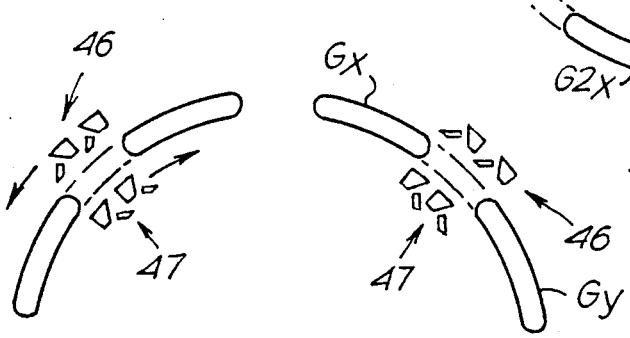
Fig. 4
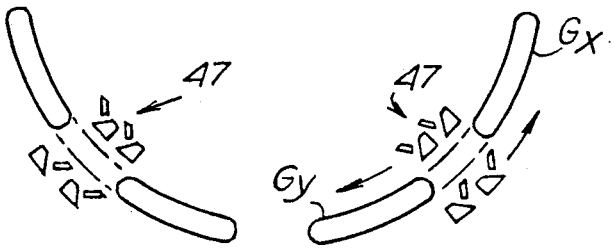

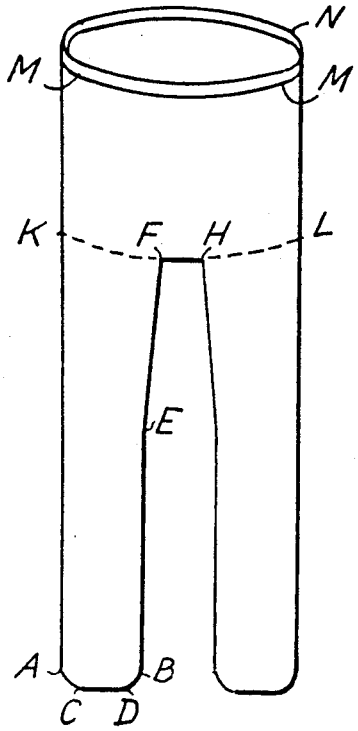
Fig. 14
Fig. 16
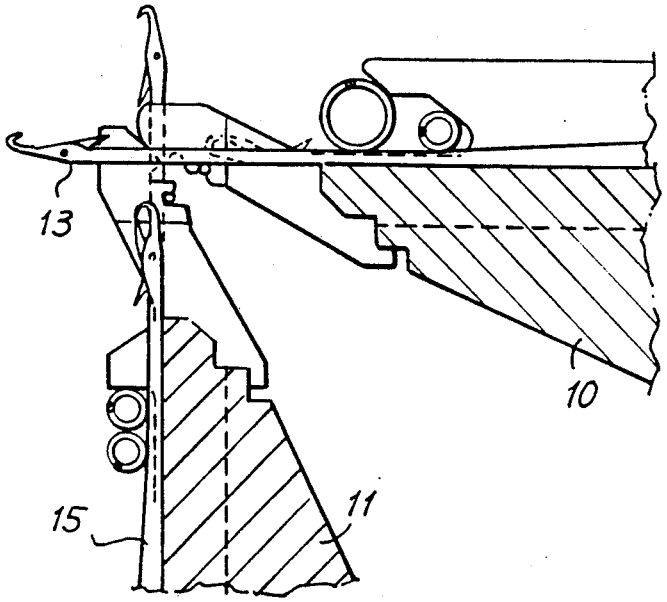
Fig. 15
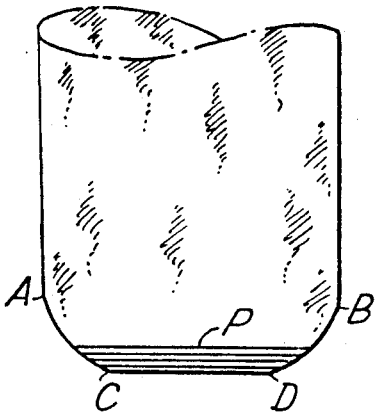
Fig. 17
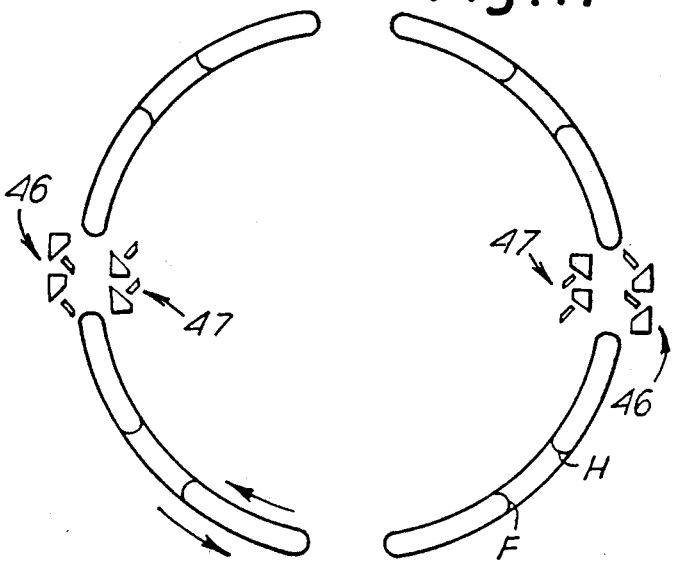

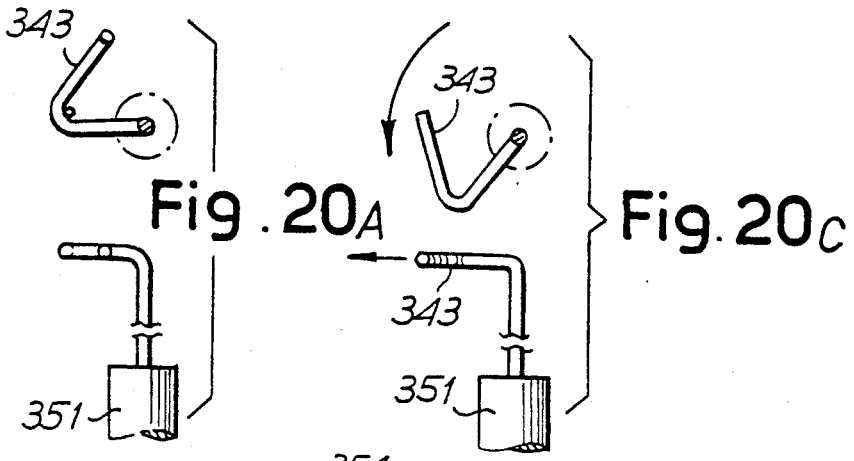
Fig. 20A
Fig. 20C
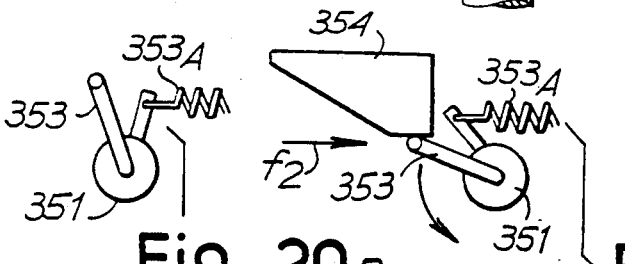
Fig. 20B
Fig. 20D
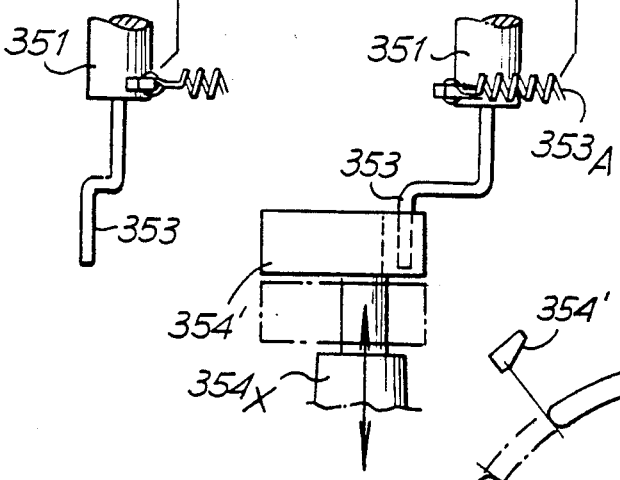
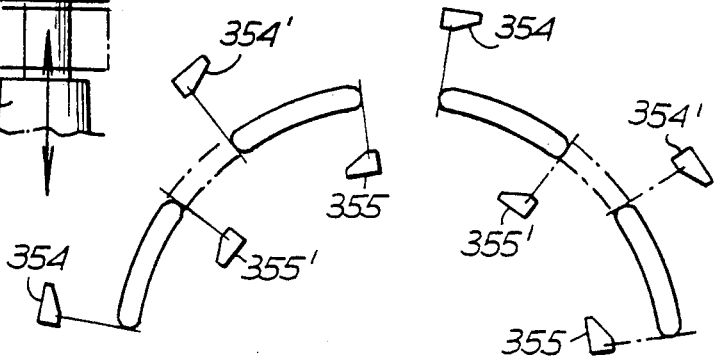
Fig. 21
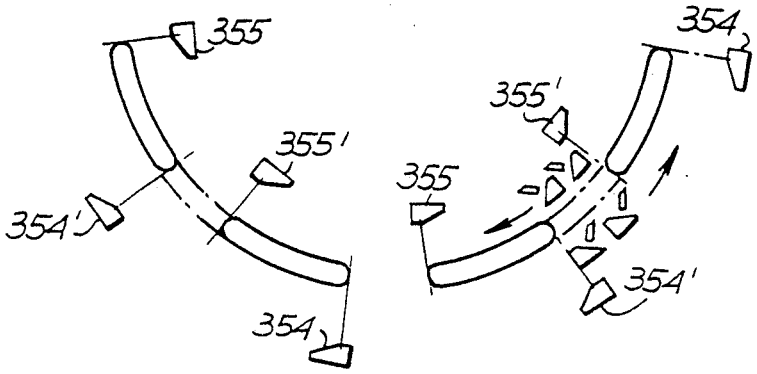

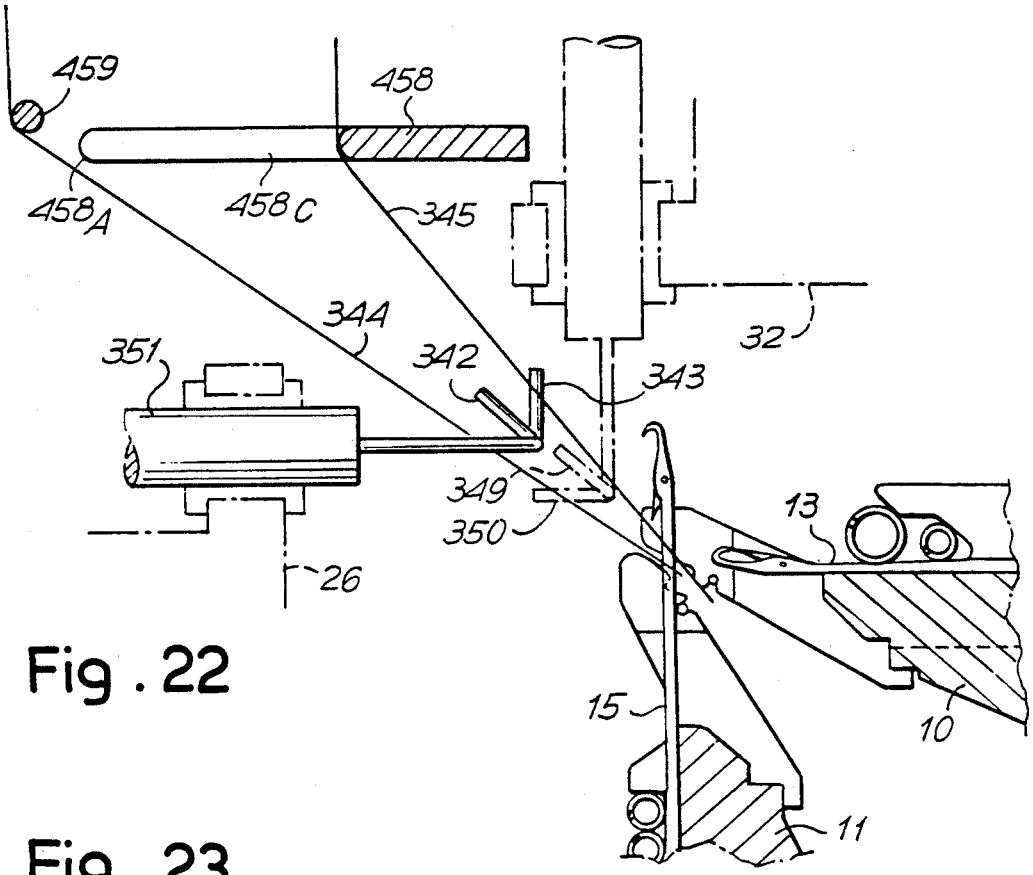
Fig. 22
Fig. 23
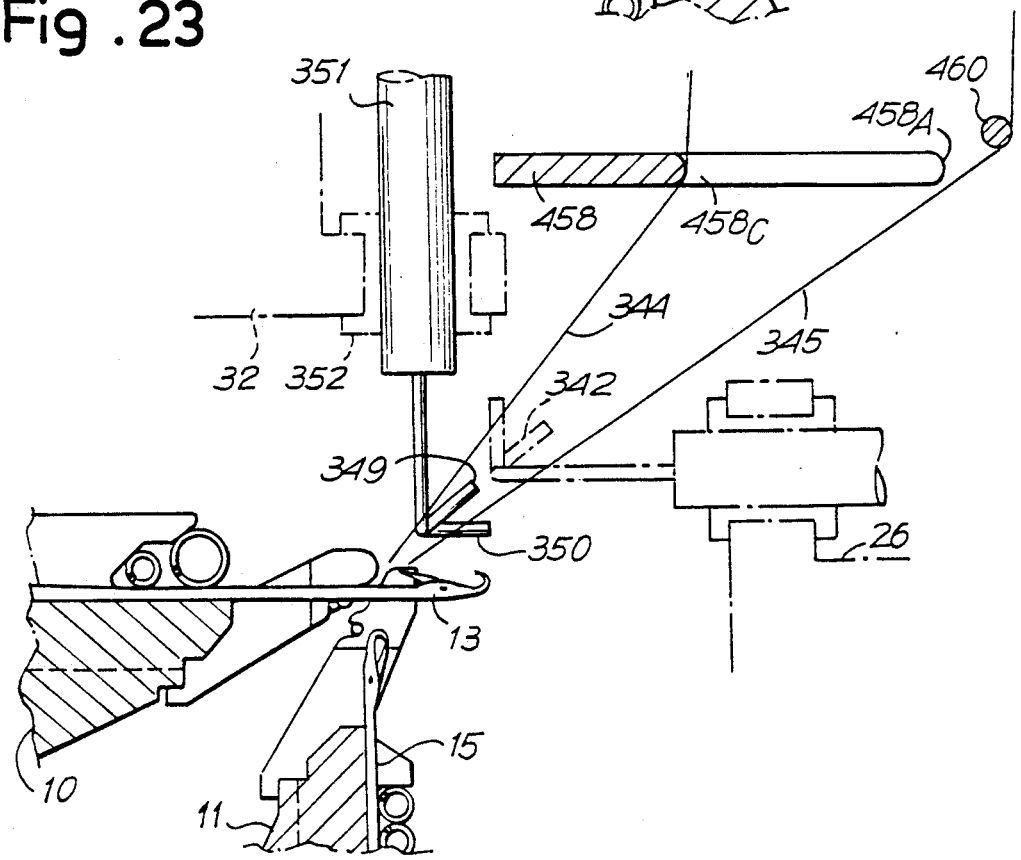

345
344
460
458
Tp
G1X
Tc
B
D
C
15
459
G2Y
G2X
458C
458A
458B
G1Y
462
472
471
461
459

459
471
458C
458A
462
472
GIX
GIY
TC
TP
C'
D'
A'
458B
458
461
345
344
471
15
13

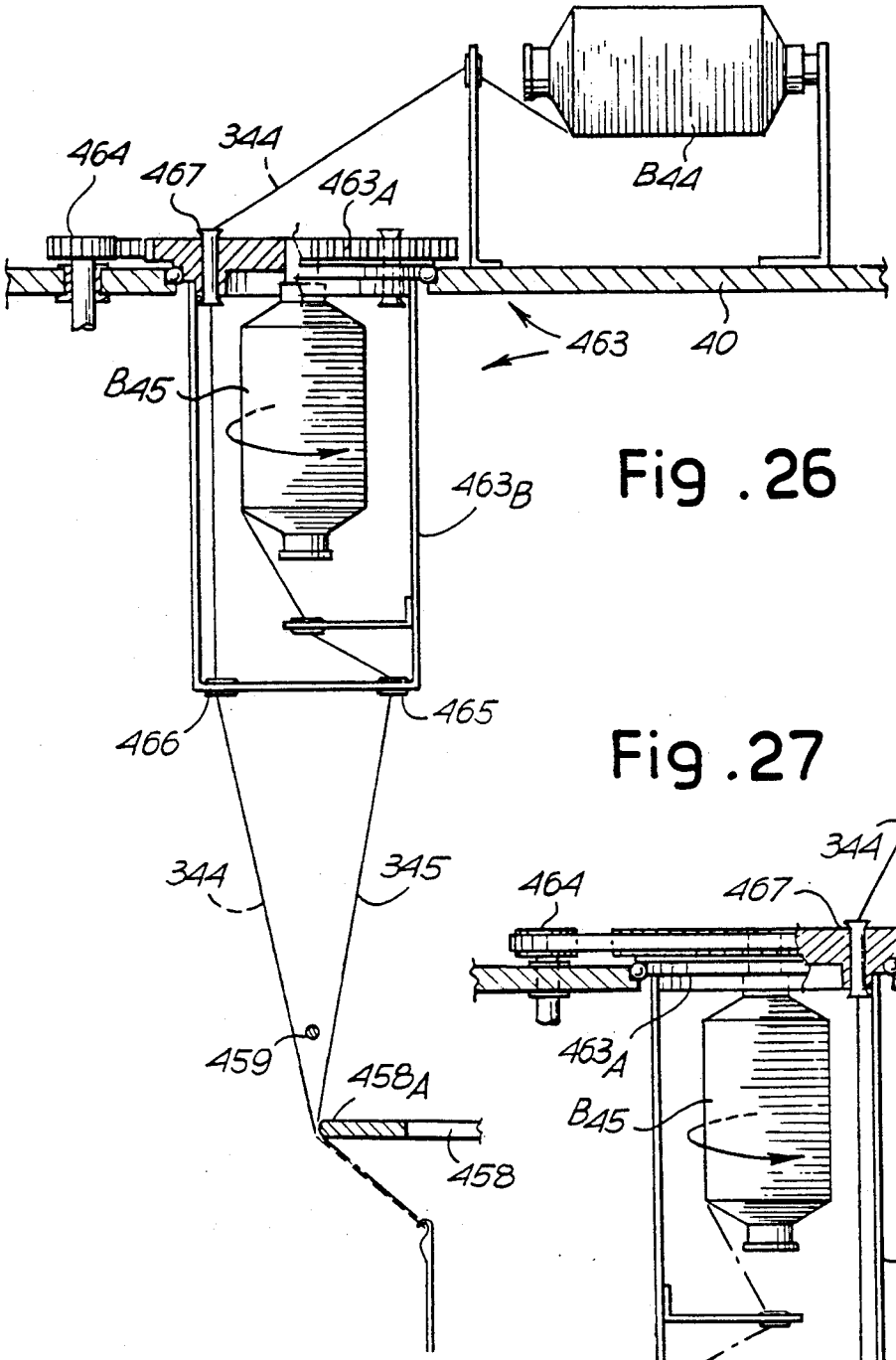
Fig .26
Fig .27
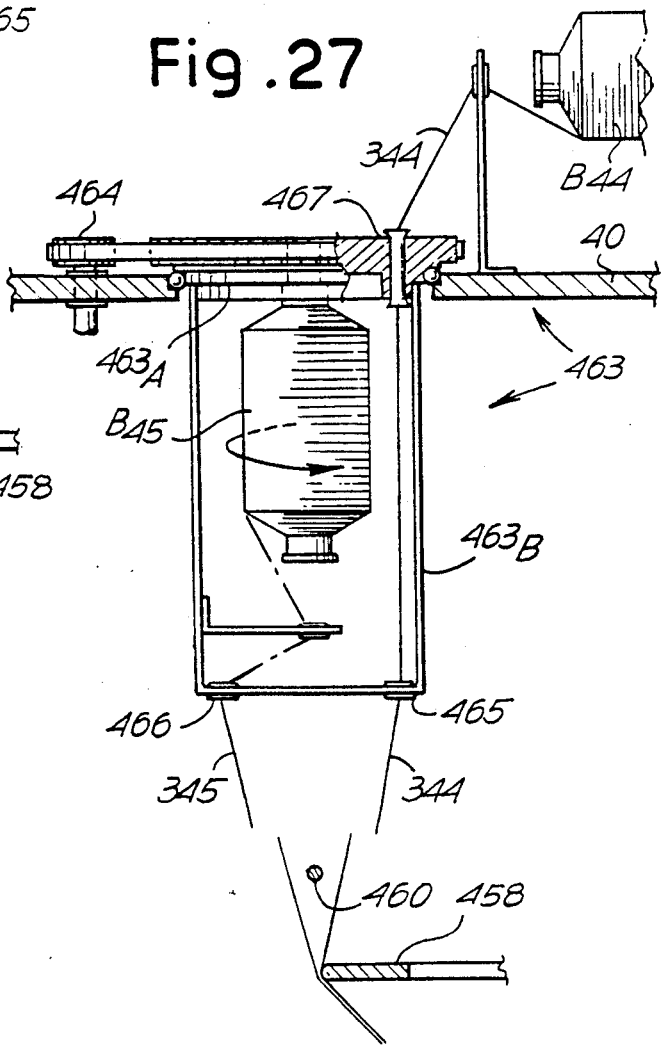

485
490
488
491
484
f 485
344
489
458
483
492
353
351
350
15
11
10
f 485
483X
f F

CIRCULAR TEXTILE MACHINE FOR SIMULTANEOUSLY FORMING A PLURALITY OF TUBULAR KNITTED ARTICLES SUCH AS PANTY-HOSE (TIGHTS) AND THE LIKE

FIELD AND BACKGROUND OF THE INVENTION

The invention relates to a knitting machine for the simultaneous manufacture of a plurality of tubular articles, specifically garments known as panty-hose and the like. Said machine is of the type comprising: two fixed circular bars of needles (one of which is mostly on a cylindrical bed of needles and the other on a discoid bed of needles, referred to as a plate, in which the needles are disposed radially); two sets of control cams for the needles of the two bars, carried by two apparatuses rotating in opposite directions and coaxially to the two bars; and means carried by said two apparatuses for the alternating entrainment of the yarns with subsequent passage to the entraining means of said two apparatuses, in order to supply the yarn for the needles in the zone momentarily controlled by the cams in transit. The articles are formed by spaced arcs of needles of the two bars, one or more yarn feeds being provided for each arc, the yarn being entrained in both directions along the respective arc; each circumferential row of stitches is formed half by the needles of one bar and the other half by the needles of the other bar. Alternate rows can be produced with different types of yarn.

On the needles of each arc or separate set of needles, in order to form a panty-hose with a variable number of needles, the following are made: first, rows suitable for creating the closure of the toes; then the tubular part of the legs; then the closure part for the crutch; and then the part known as the body or pants which forms the continuation and the junction of the two legs made initially; finally, an elastic belt is made with double fabric, which is capable of supporting the garment.

On each of the two counter-rotating apparatuses, the cams acting on the needles are formed by a plurality of sets of double and contiguous cam systems for raising and lowering the needles in order to form the stitch.

BACKGROUND OF THE INVENTION

A machine of the abovementioned type is described in the following Patents: Italian Patent application No. 470 A/84, filed on Aug. 1, 1984; European Patent application No. 85/830,201.1 of July 26, 1985; Canadian Czechoslovakian Patent application No. PV 5632-85 of Aug. 1, 1985; East German Patent application No. 79,146-3 of July 30, 1985, granted under No. 239,616 on Oct. 1, 1986; Japanese Patent application No. 68,699/85 of Aug. 1, 1985; Spanish Patent application No. 545,761 of July 31, 1985, granted under No. 545,761 on May 20, 1986; Taiwan Patent application No. 74/103,377 of Aug. 1, 1985; Russian Patent application No. 3,932,561/12 of Aug. 1, 1985; American Patent application No. 758,540 of July 24, 1985, granted under No. 4,689,971 on Sept. 1, 1987; People's Republic of China Patent application No. 86/100,603 of Jan. 23, 1986. A proposal that two (or more) yarn feeds be used for each article, in simultaneous production, is contained in the following Patents, having the priority Italian Patent application No. 9527 A/85, filed on Nov. 28, 1985: European Patent application No. 86/830,356.1 of Nov. 28, 1986; Czechoslovakian Patent application No. PV 8557-86 of 24th Nov. 1986; Japanese Patent application 279,909/86 of Nov. 26, 1986; U.S. Pat. application No. 932,913 of Nov. 19, 1986, granted under No. 4,724,687 on Feb. 16, 1988. This last prior patent suggests a method of avoiding the crossing of the two yarns of the two feeds in the passage from one bar to the other, while always keeping the same yarn in the forward position and always the same yarn in the rearward position; this proposal is also extended to machines having two fixed circular bars of needles (FIG. 13 of this last-named patent).

SUMMARY OF THE INVENTION

Substantially, the circular textile machine according to the invention for simultaneously forming a plurality of tubular knitted articles, including shaped and finished articles, is of the type comprising: two fixed bars, i.e. beds, for knitting needles, a plurality of articles being simultaneously formed on individual arcs of needles corresponding to said two bars, each having rows constructed partly by the needles of one bar and partly by the needles of the other bar; two apparatuses rotating in continuous motion and in opposite directions, and one carrying the control cams for the needles of one bar and the other the control cams for the needles of the other bar; and, on each of said apparatuses, means for entraining the yarn alternately in the two directions along the respective arc which is forming an article, the exchange of the yarn between the two counter-rotating entraining means taking place at the ends of the respective working arc of needles. According to the invention, said machine further comprises, in order to obtain two successive yarn feeds for each working arc of needles and always having the same thread fed first, in order to form rows of the continuous helical type: two successive yarn feeds; means for guiding and switching the position of the two yarns in order to supply them to the needles at two angles and to exchange their positions at each reversal of the entrainment thereof by the entraining means; as entraining means, pairs of hooks with the hooks of each pair being disposed one behind the other in the direction of the respective direction of advance, and the first being shaped so as to penetrate into the space between the two threads to grip only one thereof and the second being shaped to grip the other thread; on said two counter-rotating apparatuses, supports for said hooks to permit the displacement thereof between an engagement position of the thread and a release position of the thread; and, on the fixed structure, control means for bringing about the timely displacements of the hooks at the end of the active travel along a working arc.

In practice, said hooks may possess differently shaped active ends, they may be supported so as to be angularly mobile along axes orthogonal to the active ends, and they may possess cranks interacting with active cam control means against the action of restoring means of the spring type or cam type respectively. One of said hooks may be bent at about 45° to grip the anterior thread and the other may be bent at about 90° to grip the other thread. Alternatively, one of said hooks may be shorter in order to grip the anterior thread, and the other may be longer in order to grip the other thread.

In a preferable form of embodiment, in which the two beds of needles are in the one case on a cylinder and in the other case on a plate, the hooks for guiding the threads to the needles of the cylinder are mobile along axes which are approximately radial to the outside of the bar of the needles of the cylinder, while the hooks for guiding the threads to the needles of the plate are mobile along axes approximately orthogonal to the plate and above the bar of the needles of the plate.

The switching and guide means for the fed threads may comprise: thread unwinding apparatuses, each combined with two bobbins of yarn and each comprising a rotating assembly (plate and frame) having two off-center outlet eyelets; and means for causing the threads to be engaged by the hooks of both pairs at the end of each entrainment travel and at each exchange of the threads which pass inside and outside. The abovementioned means for causing the threads to be engaged by the hooks may comprise: a ring having a shaped profile forming recesses and projections, extending along the two bars; pairs of rigid guide wires disposed symmetrically on said ring having their free ends opposite and set at a limited distance relative to a projection of said ring and raised relative to said projection. Said thread unwinding apparatuses have the rotating assembly (plate and frame) having two outlet eyelets which are off-center relative to the axis of rotation, which axis passes approximately through the projecting zone of said ring in order to obtain a cyclical displacement of the trajectory of the two threads between said eyelets and said projection and the exchange of the threads which pass inside and outside the guide wires in the sliding of the threads along said profile of the ring under the action of the entrainment alternately effected by said hooks.

For each fed thread, the machine comprises: a pincer mechanism capable of engaging and cutting the thread to be excluded and presenting it to be gripped by the arriving hooks; means for displacing said pincer mechanisms and means for controlling the gripping and cutting members thereof. The abovementioned means may comprise: a support having an oscillating arm articulated on the fixed structure, for the pincer mechanism; an actuator for displacing said arm support in two active positions; an actuator for causing the pincer mechanism to slide relative to the arm support; and an actuator for controlling the members of the pincer.

When the machine is designed to form garments of the type of tights or the like—with knitting of two tubular parts on two contiguous arcs of the two bars of needles and with subsequent knitting of a single tubular part as an extension of the two tubular parts and of the portion formed by the needles of the needle zone comprised between those of said two contiguous arcs—said machine may comprise: articulation means for two guide wires belonging to two contiguous pairs of said guide wires, and situated in line with the needle zone (crotch) comprised between those of the two contiguous arcs of the two tubular parts to be joined; and control means for excluding said two guide wires from the active position and bringing them into the active position in synchrony with the action of said pincer mechanisms.

In practice, the unwinding apparatuses may be carried by mobile support members in order for an unwinder always to be displaced into a substantially intermediate position with respect to the needle arc of the two bars fed by the unwinder in question. In particular, an annular member may be provided which supports all said unwinding apparatuses and is angularly displaceable on the fixed structure; an actuator is able to displace said annular member in order to enable each unwinding apparatus, in the operating state, to reach a substantially intermediate position with respect to the needle arc of the two bars of said fed apparatus. Alternatively, slide-type support members, which are mobile on approximately tangential guides, may be provided, each of said slides carrying two unwinding apparatuses.

The machine may comprise sets of cams for controlling the needles of the various bars, each of which sets comprises two cams for lowering the needles, one of which cams can be excluded, and subsequent raising cams. With these arrangements, it is possible to achieve: by including said excludable cams, the formation of two rows of stitches with the two threads successively fed, and by excluding said excludable cams, selection by means of advanced and delayed raising of the needles, thus forming a fabric having the design known as "slip stitch", with a single lowering and with the formation of a single row of stitches.

At the start of the formation of the body, the needles of the two bars situated in the section (crotch) comprised between the zones of formation of the two legs are controlled to cross and form joining stitches with at least one closure row, actuated—like the body—by two threads fed like those for the formation of a leg. Together with the needles of the section (crotch) comprised between the zones of formation of the two legs there may also be raised, in order to cross each other, at least one needle of each bar which is contiguous to those of said section (crotch) and which has operated to form the legs; the result of this is to eliminate, or at least reduce, eyelets which would otherwise form in the article at the ends of the closure zone of the crutch.

For the selective control of the needles—which are always in a fixed position, the bars not being mobile —an electromagnet may be provided which acts on each needle or needle selector; said electromagnets may be arranged in a plurality of ranks in order to increase the space available for each electromagnet.

BRIEF DESCRIPTION OF THE DRAWINGS

The invention will be better understood by following the description and the attached drawing, which shows a practical, non-limiting embodiment of said invention. In the drawing:

BRIEF DESCRIPTION OF THE DRAWINGS

Figure 1:
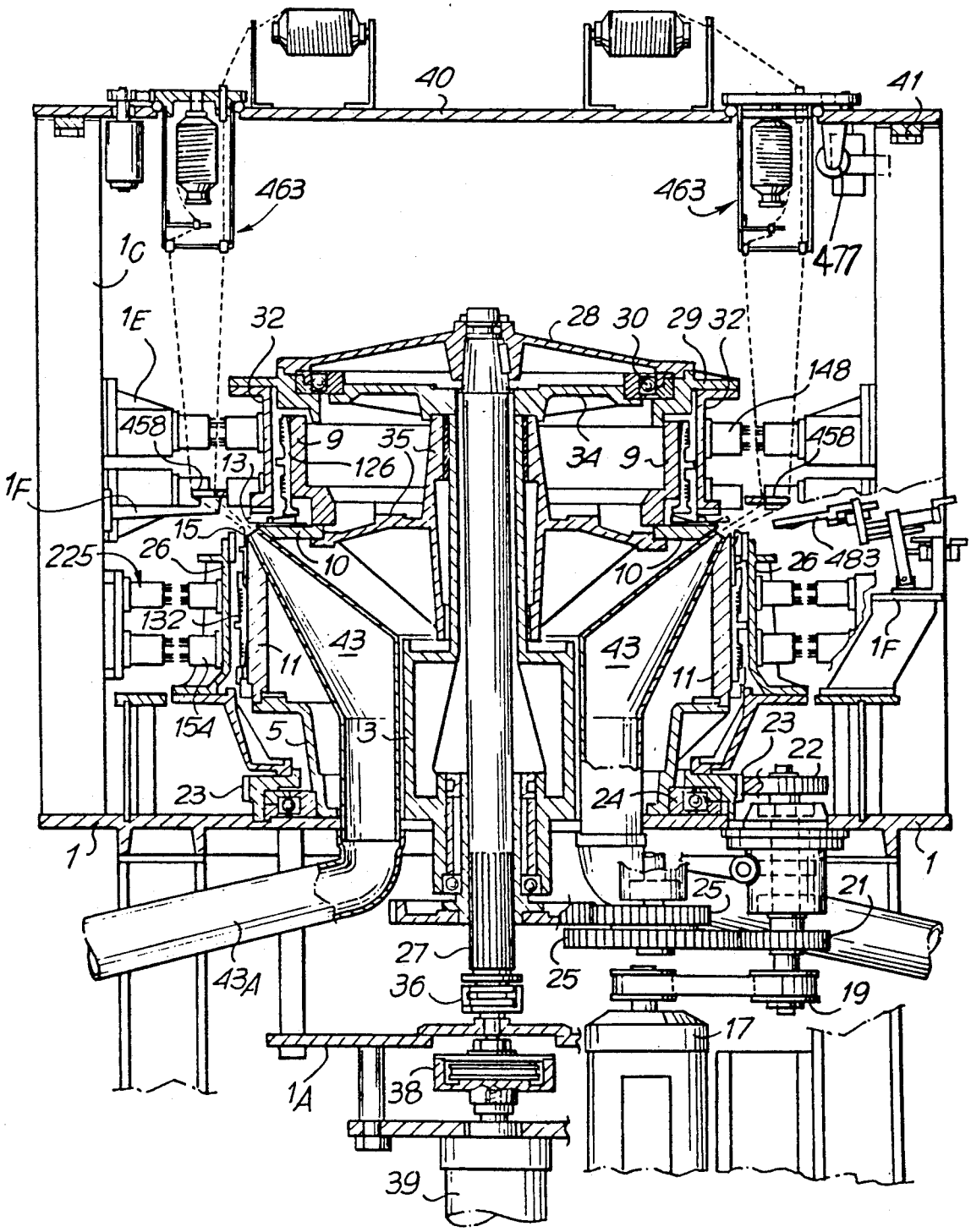
Figure 5:
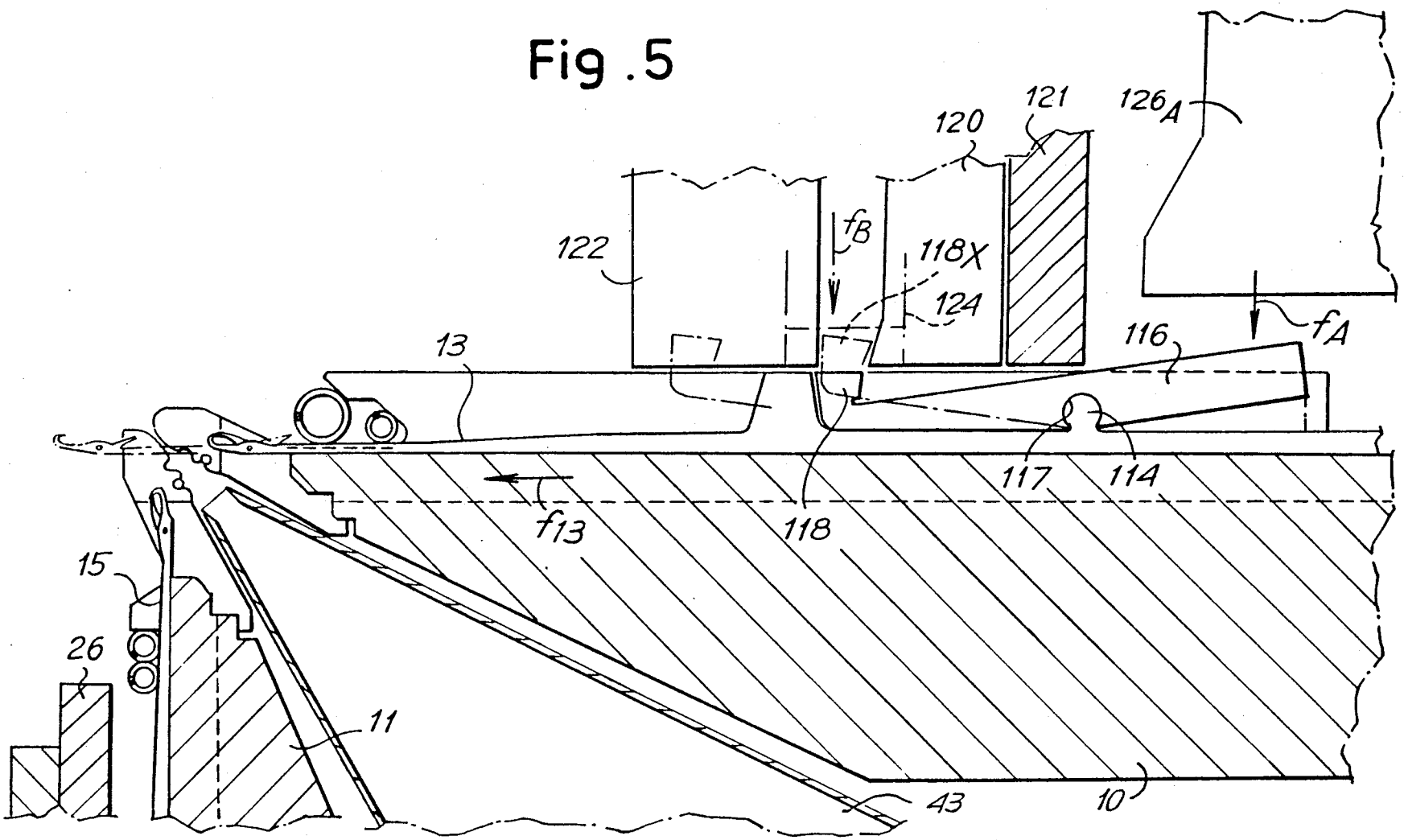
Figure 6:
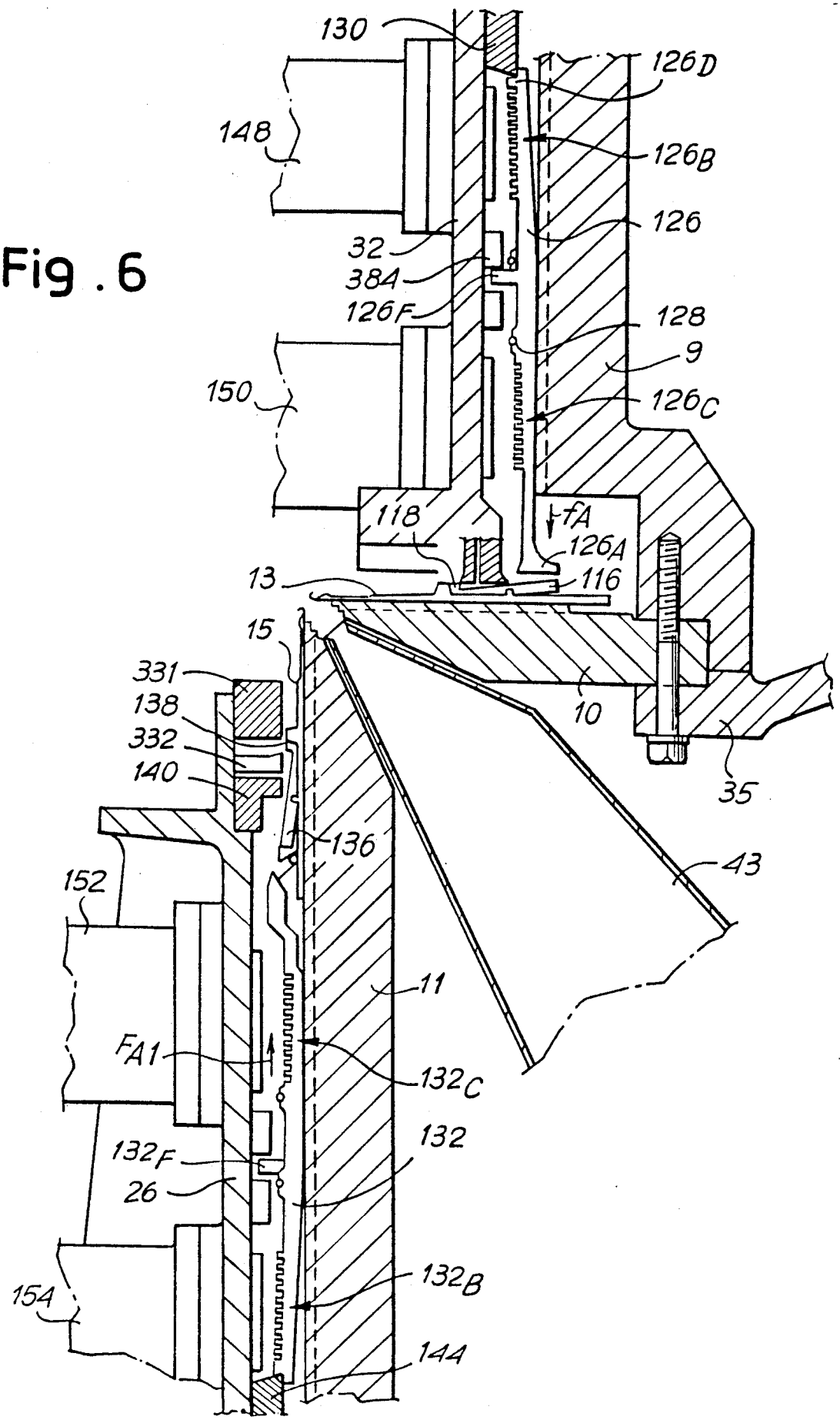
Figure 7:
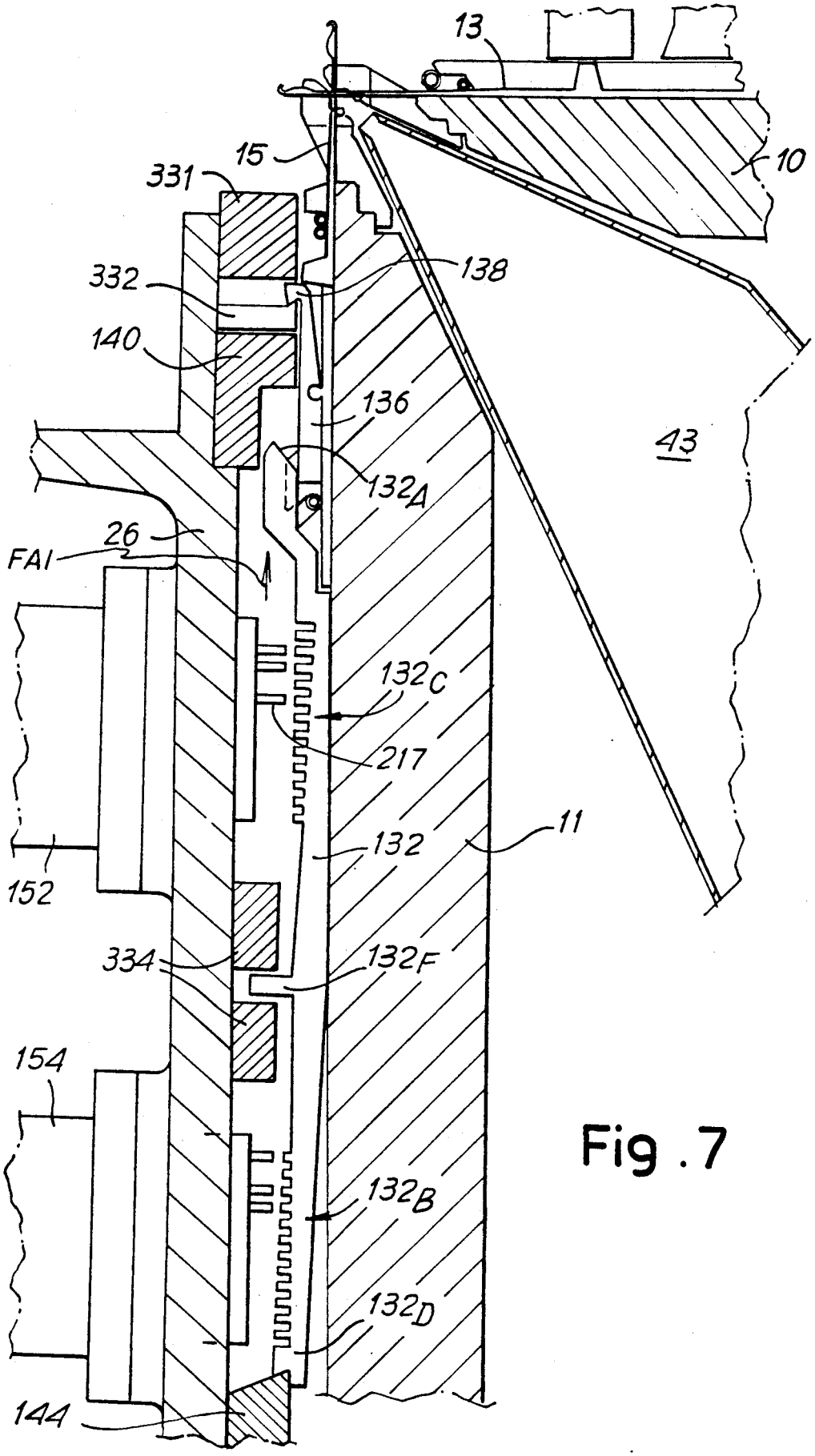
Figure 8:
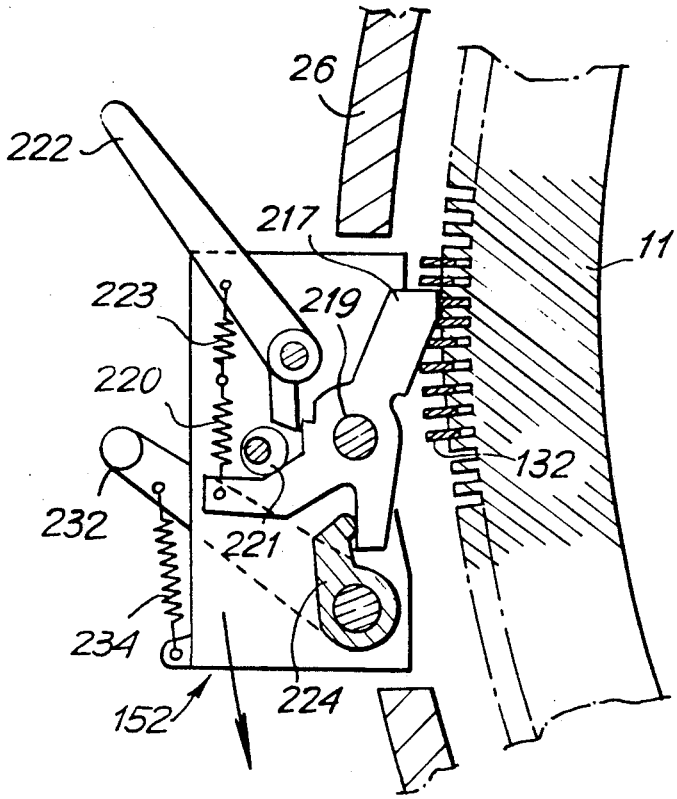
Figure 9:
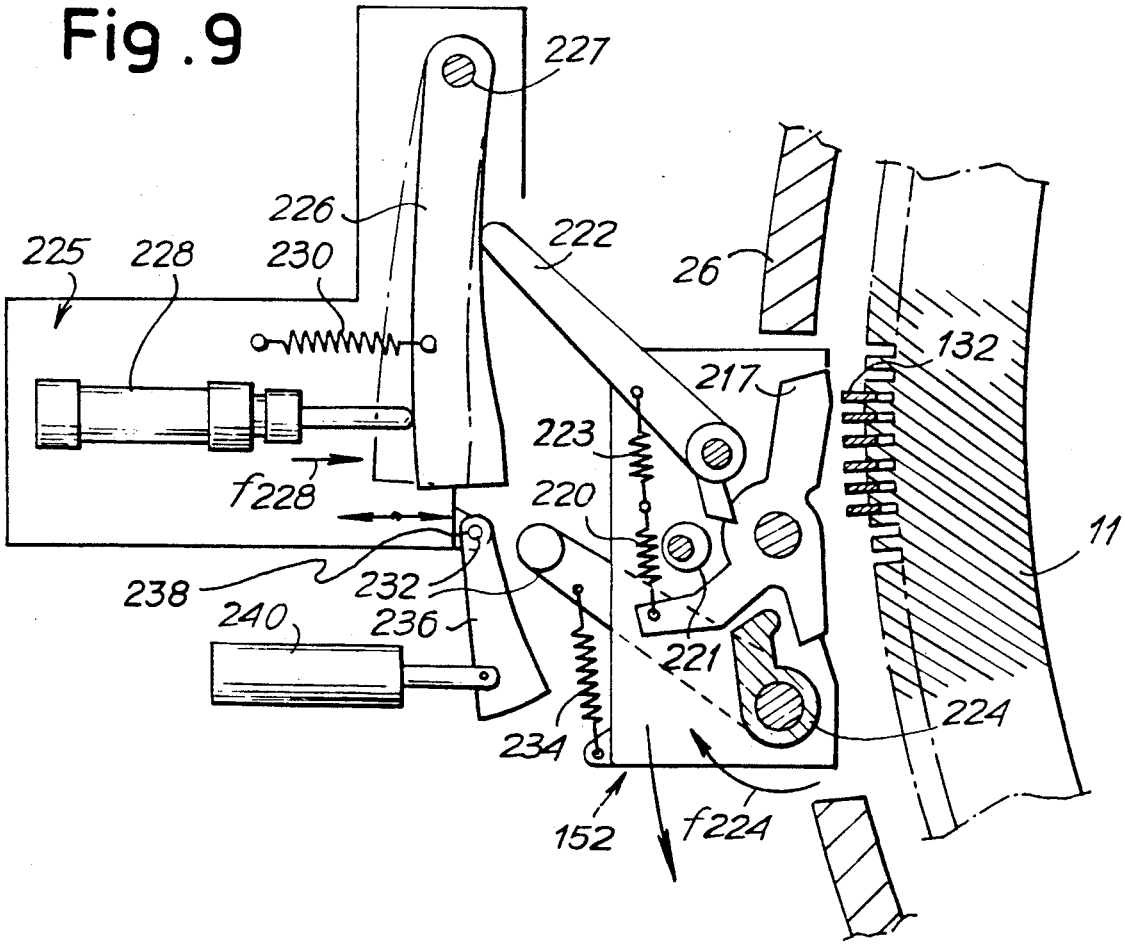
Figure 19:
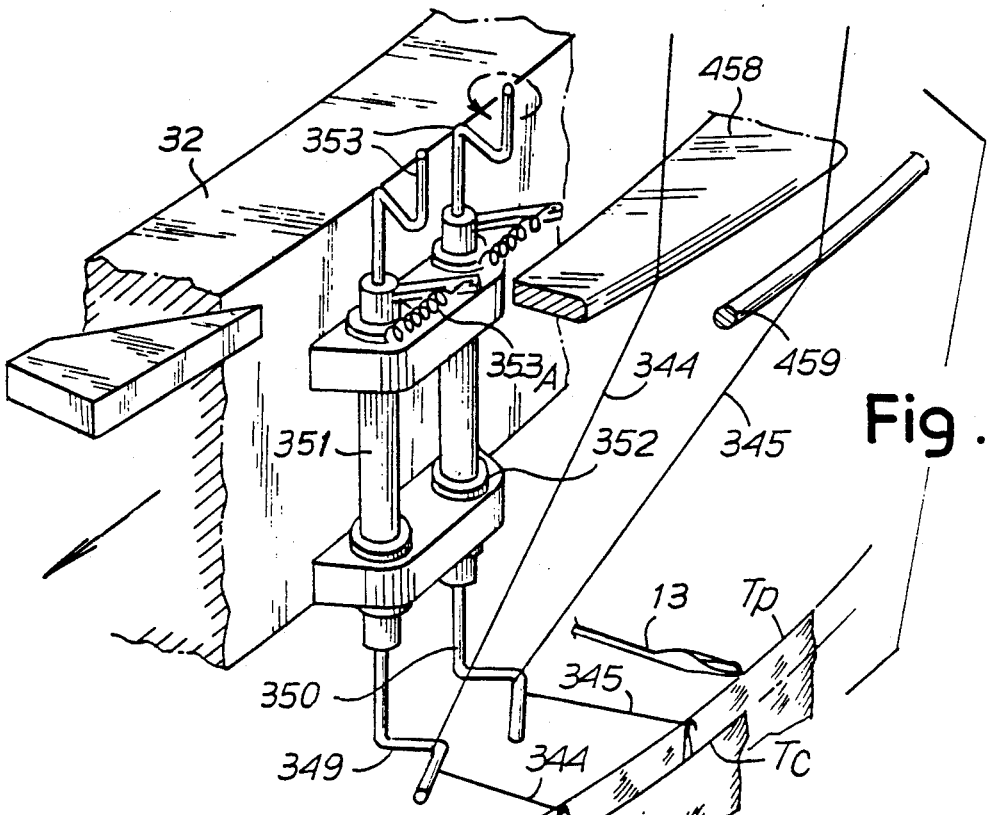
Figure 18:
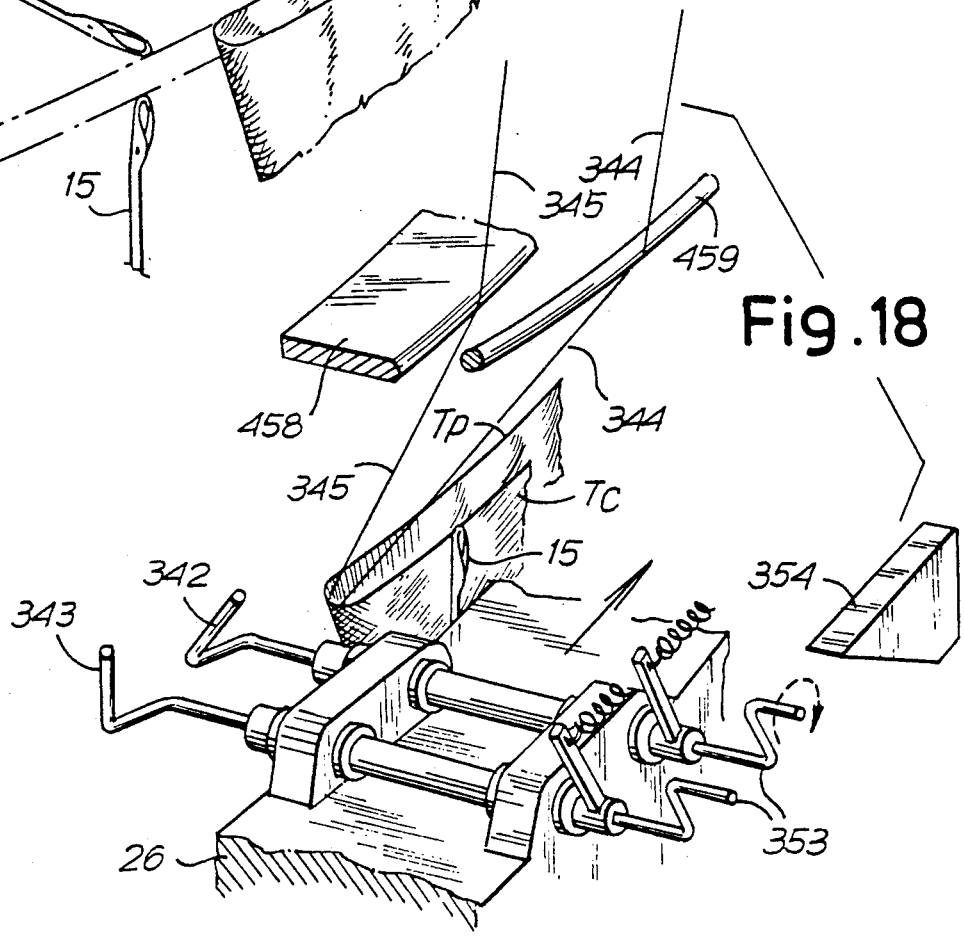
Figures 24, 24B, 24C, 24D:
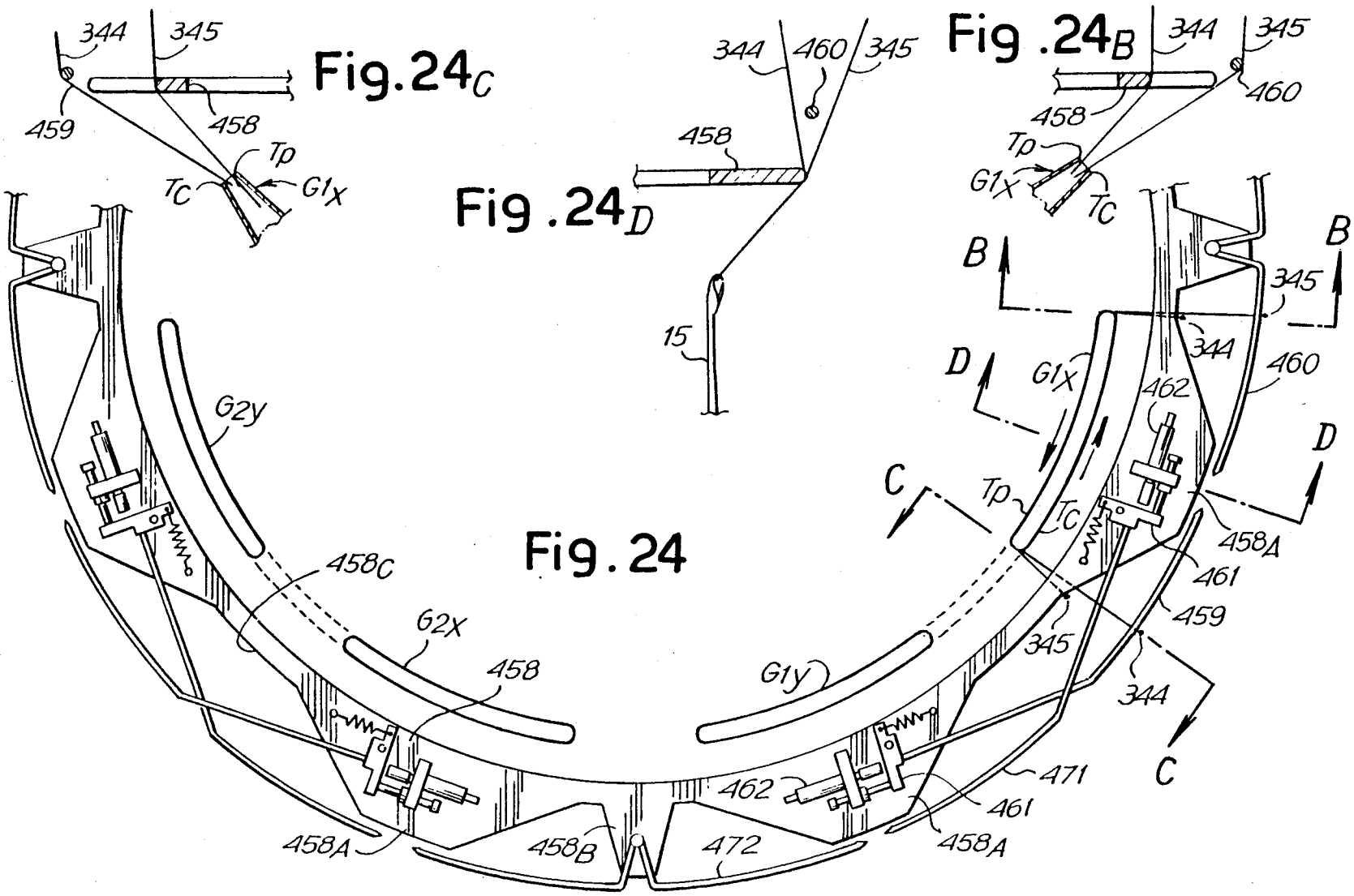
Figures 25, 25A, 25C, 25D:
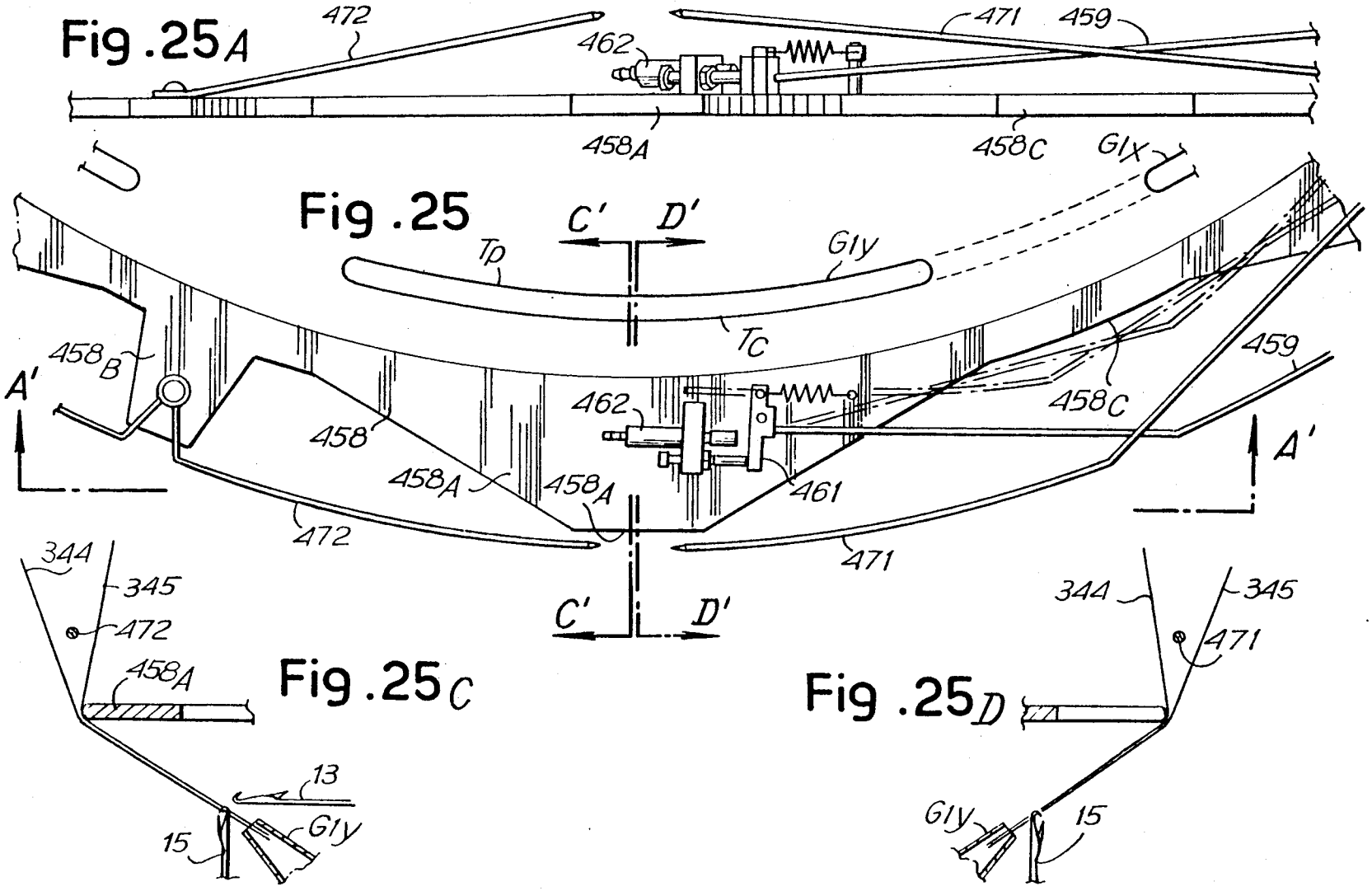
Figure 28:
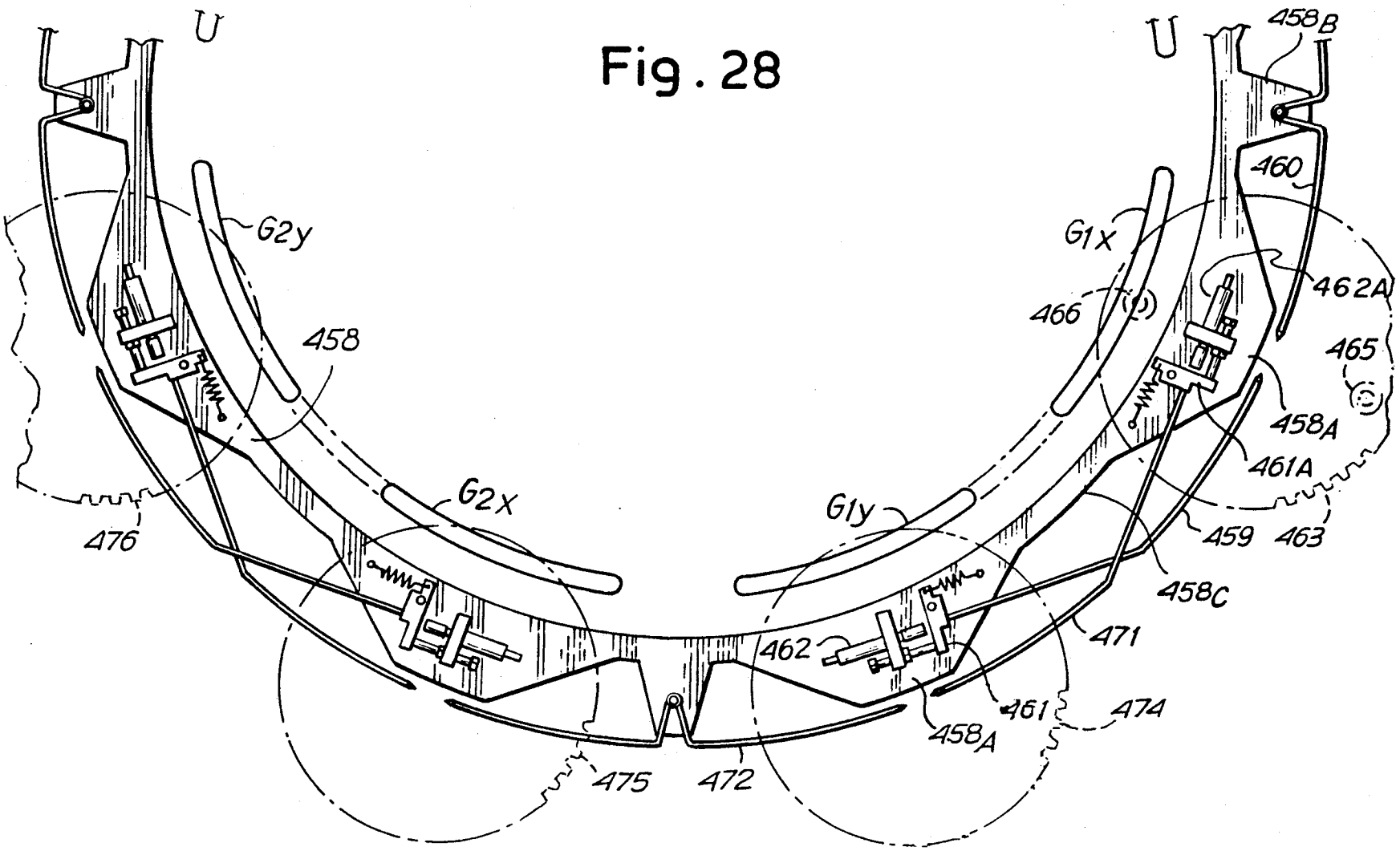
Figure 29:
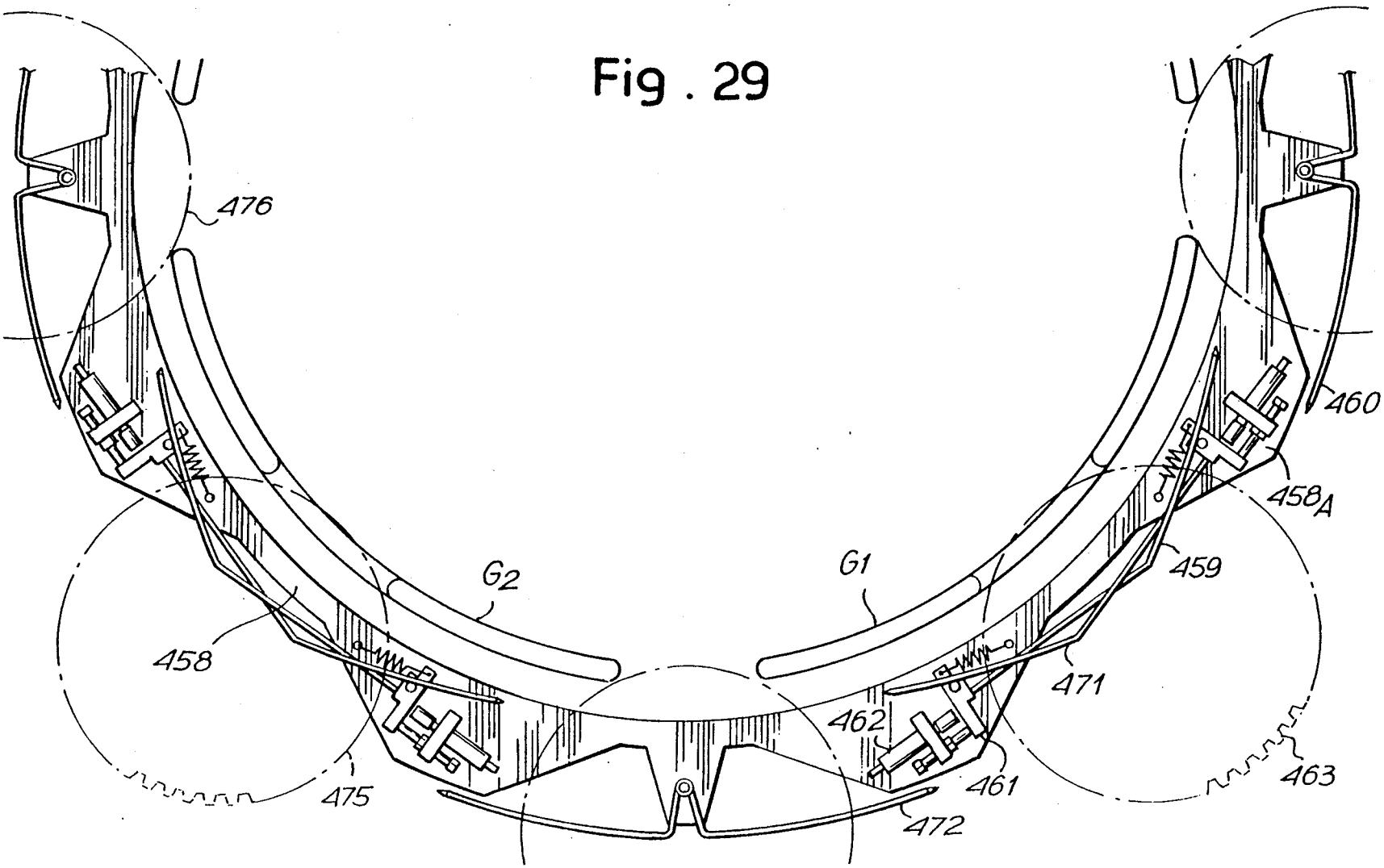
Figures 30, 31:
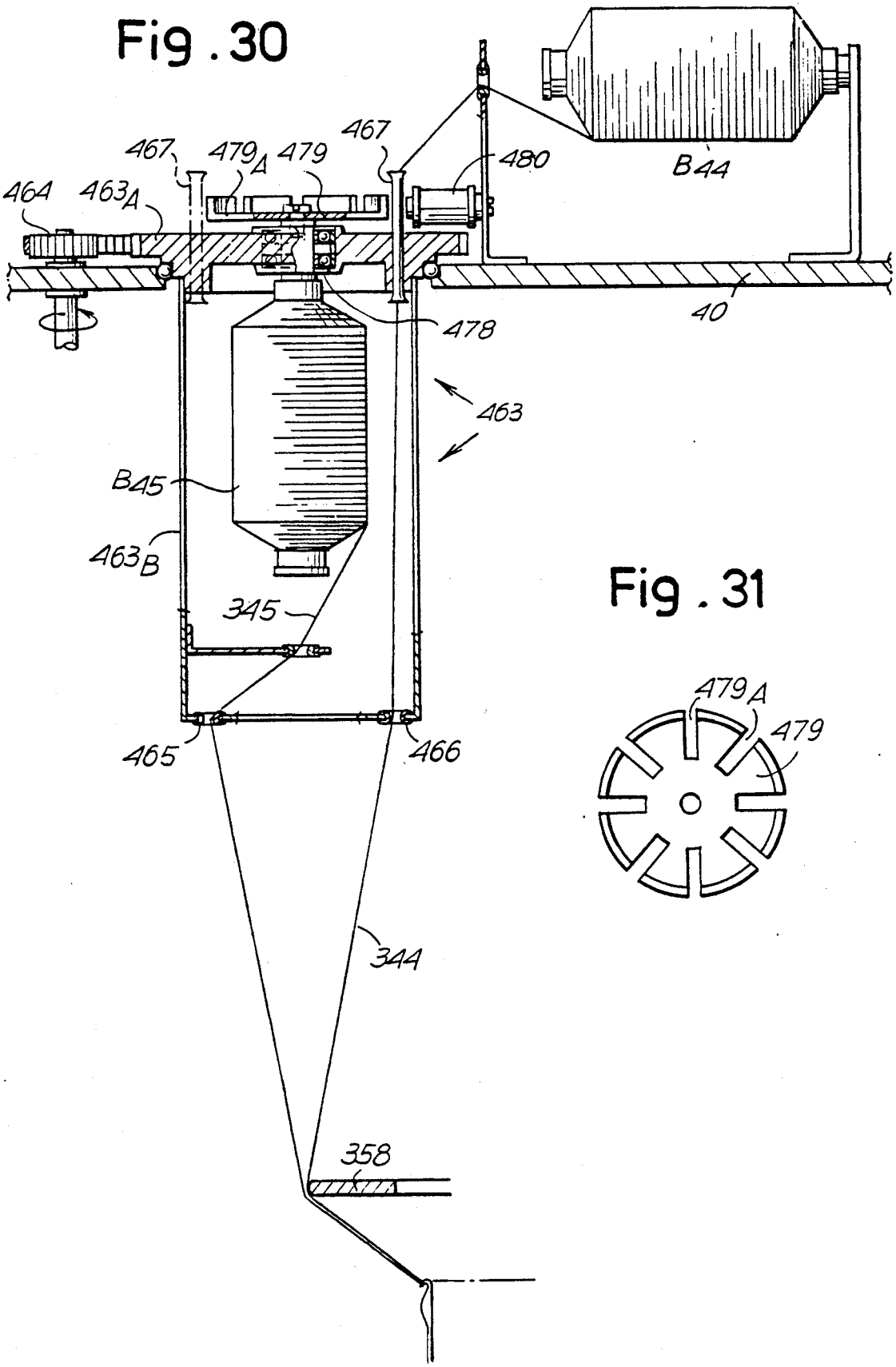
Figure 36:
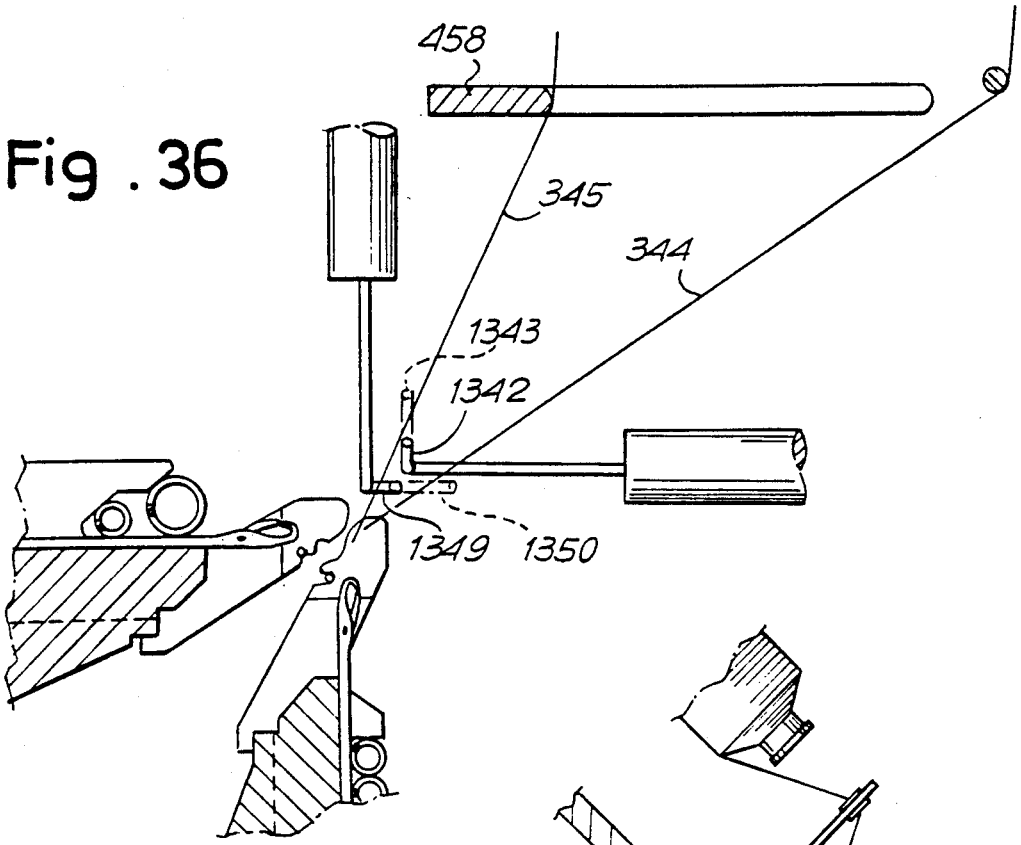
Figure 38:
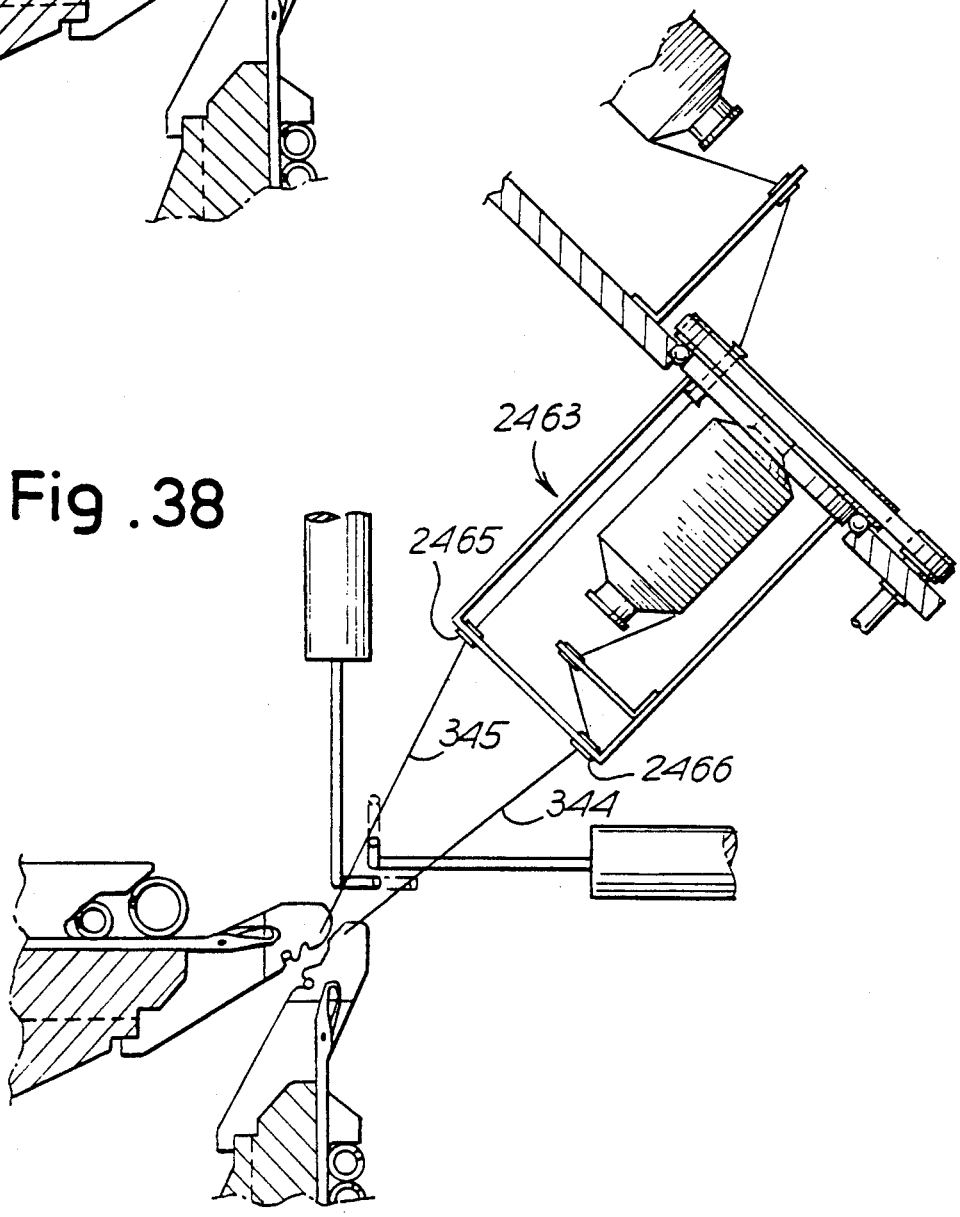
Figure 37:
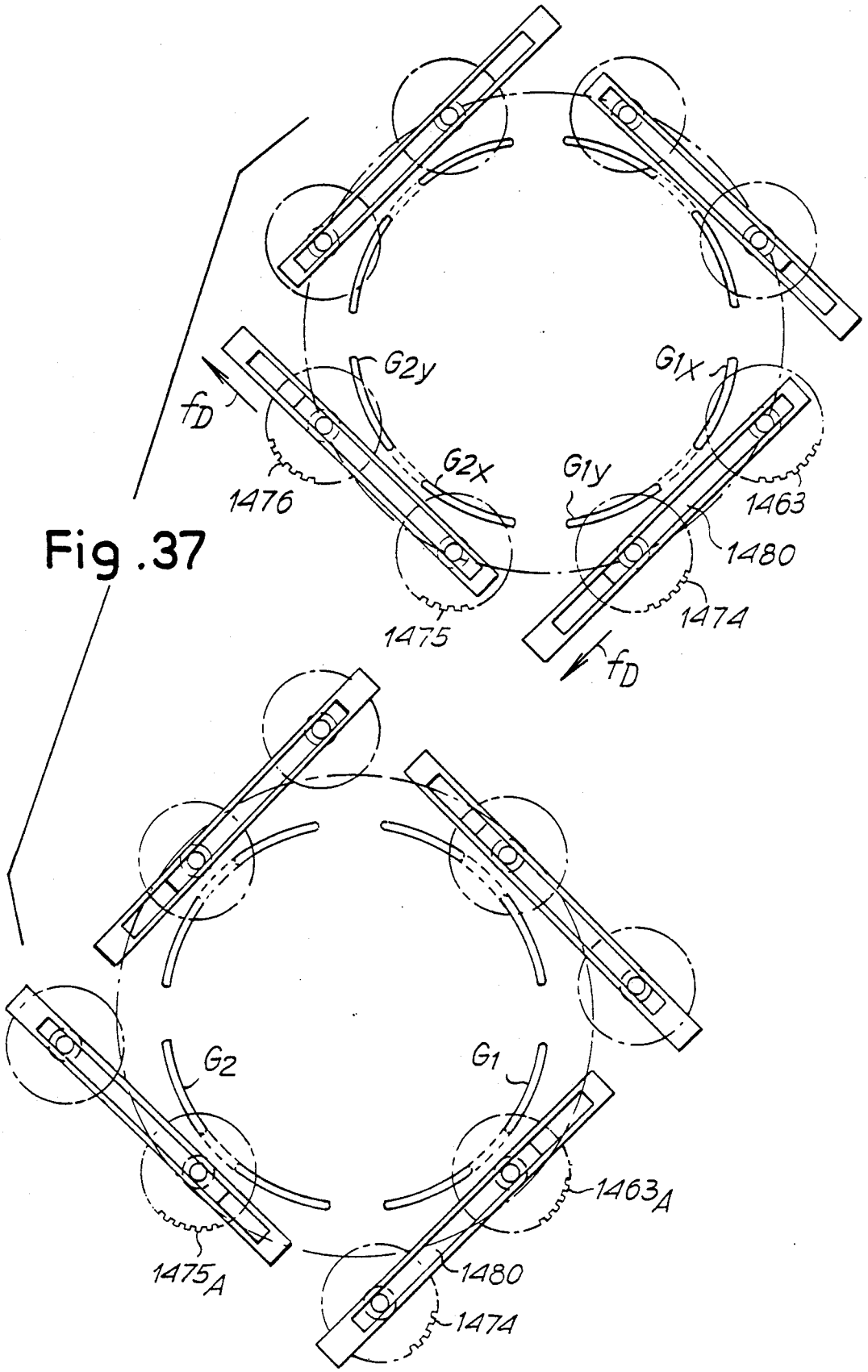

FIG. 1 shows a complete general axial section through a machine;

FIGS. 2, 3 and 4 show diagrammatically the status of the machine during the formation of four bodies and in the exchanges of thread between the two bars in the formation of the eight legs;

FIGS. 5, 6 and 7 show sectional details of the bar of the plate, of both bars and of the bar of the cylinder;

FIGS. 8 and 9 show components for the selection of the needle selectors, on the counter-rotating apparatuses and on fixed parts;

FIGS. 10, 11, 12 and 13 show the shells of the selection cams of the two needle bars, respectively in two operating states;

FIG. 16 shows the working zone with the needles of the two bars activated and crossed, in the states for starting the toes and closing the crutch zone;

FIG. 17 shows, diagrammatically, a thread exchange state during the production of the body;

FIGS. 18 and 19 show, in perspective and in isolation, a hook for entraining the thread, for the needles of the cylinder and for the needles of the plate;

FIGS. 20A, 20B, 20C, 20D show various partial views of the status of the hooks in the position of gripping and releasing the thread, and the associated control means;

FIGS. 22 and 23 show the working zone of the needles in the states of feeding the threads to the needles of the cylinder and to the needles of the plate;

FIGS. 24, 24B, 24C, 24D and 25, 25A, 25C, 25D show, in partial plan view and in sections along B—B, C—C and D—D in FIG. 24, guide means for the fed threads, and further details in plan view and in sectional views along A'—A', C'—C' and D'—D' in FIG. 25;

FIGS. 26 and 27 show, in two attitudes, a yarn unwinding apparatus, in vertical section;

FIGS. 28 and 29 show, in a partial plan view, the positions assumed by the unwinders in the production of the legs and of the bodies;

FIGS. 30 and 31 show, in vertical section and in a partial plan view, an alternative embodiment of an unwinder;

FIGS. 32, 33, 34 and 35 show, in elevation, the three positions which may be assumed by a thread cutting and gripping pincer, and a partial plan view;

FIG. 36 shows an alternative embodiment of the hooks;

FIG. 37 shows a variant of the device for displacing the unwinders;

FIG. 38 shows an alternative embodiment of the arrangement of the unwinder; and

Figure 39:
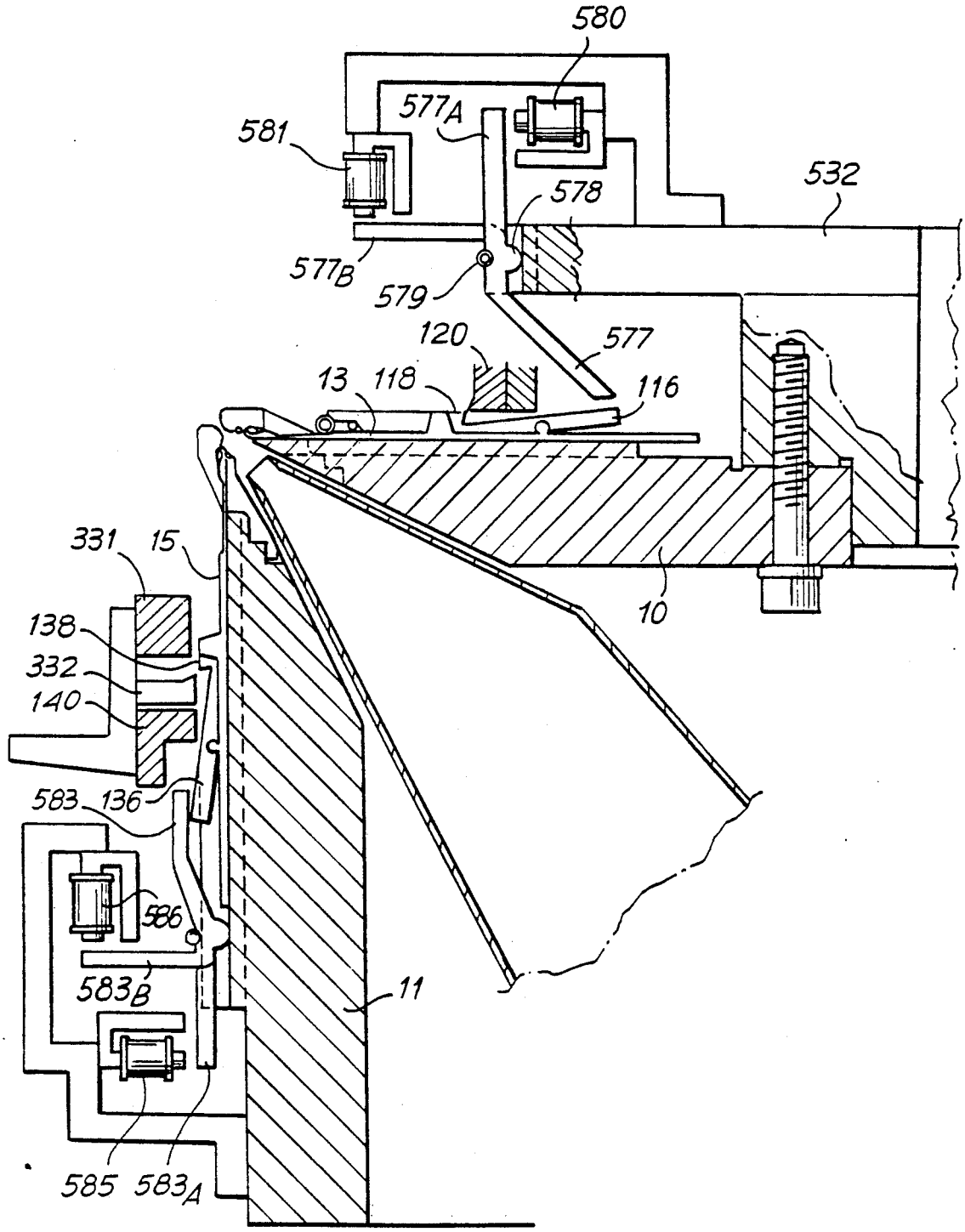

FIG. 39 shows an electromagnetic embodiment of the control for selecting the needles.

DETAILED DESCRIPTION OF THE PREFERRED EMBODIMENTS

FIG. 1 shows a generic section of the machine which serves principally to illustrate the entirety of the mechanical construction. The fixed structure is in the various parts designated 1. Via a central element 3 and an annular element 5, the structure 1 supports a plate-type bar 10 and a cylinder-type bar 11 for the needles 13 and 15 respectively. 17 designates the motor, which transmits the movement via toothed belts to the pulley 19 mounted on the movement intake shaft 20. The rotary intake motion is then transmitted to two cylindrical gears 21 and 22. The gear 22 transmits the motion to a toothed wheel 23 which is mounted on a large bearing 24 supported by the structure 1; the wheel 23 supports an apparatus 26 rotating continuously about the cylinder 11, counter-clockwise in the example. The apparatus 26 bears the selection cams for the oscillating selectors for the needles 15 described below, and rotates about the cylinder 11, which is fixed. The gear 21 transmits the motion, via an idle intermediate gear composed of two coaxial, solid gears 25—for the purpose of reversing the direction of rotation—to a gear 26 coupled for rotation to a central shaft 27 which rotates counter-clockwise (opposite to the direction of motion of the toothed wheel 23). Fixed to the upper end of the shaft 27 is a discoidal support 28 which will rotate in the opposite direction to that of the unit 26, and with it a ring 29 mounted on a bearing 30 carried by the upper part of the central portion 3 of the structure 1. The ring 29 in turn carries an apparatus 32 rotating about a cylinder 9 fixed to the plate 10 and grooved in order to accommodate oscillating selectors for the needles 13, described below; said apparatus 32 bears control cams for said selectors.

The shaft 27, which transmits the motion to the apparatus 32 bearing the cams of the plate, is also mobile in the axial direction, in order to be able to raise the plate 10 with the associated cylinder 9; the vertical raising of the shaft 27 in fact causes the raising of the disk 28 which, by means of the ring 29 via the bearing 30, entrains a disk 34 fixed to a sleeve 35, which, sliding on the central guide support 3 of the structure 1, raises the plate 10 with the associated cylinder 9. The normal positioning of the shaft 27 is given by its support—via a thrust bearing 36 and a disk 37—on a plane 1A of the structure. The raising of the shaft 27 and hence of the plate 10 is obtained by means of a pneumatic cylinder/-piston system 38 when the slight lifting of a few tenths of a millimeter is needed, which lifting is necessary—as is known—during the execution of the so-called elastic double border. A much greater raising of the plate 10 (by the order of about 100 millimeters), on the other hand, is used when it is desired to inspect the machine between the two bars, on stopping said machine; such raising is obtained by means of a further pneumatic cylinder/piston system 39 which, also entraining with it the cylinder/piston system 38, raises the disk 3 and the entire set comprising the plate 10.

A superstructure 1C supports thread unwinding apparatuses 463, described below, which are carried by a discoidal member 40, mounted to rotate by means of supports 41. The threads coming from the unwinding apparatuses 463 are guided by a ring 458, described below, before being gripped by the needles; this ring 458 is supported by the superstructure 1C via arms 1E. Supports 1F of the fixed structure 1 support cutting and retaining pincers 483, described below, which serve to restrain and present the threads coming from the unwinding apparatuses 463.

Said arms 1E and/or other supports such as those 1G connected to the fixed structure 1 bear fixed selection groups, such as those 225 described below, which are disposed outside the two counter-rotating apparatuses 26 and 32.

Suction ports 43, each of which extends along an arc of needles responsible for the formation of a complete article, open within the cylinder 11, between the latter and the edge of the plate 10; these ports 43 extend as pneumatic ducts 43A for suction air currents responsible for the pneumatic tensioning of the articles being formed and for the pneumatic transporting of the detached articles.

The various assemblies can be controlled by mutually synchronized actuators and motors. The various motors are controlled by programs capable of ensuring timely variations in speed, specifically speed reductions for particular stages, such as the beginning, the closing of the crutch and the exclusion of any feeds at the start of the formation of the body, and at other stages.

Other assemblies of the machine are described and better illustrated by the description which follows and by the other figures of the attached drawing.

With reference to the prior machine, the parts which constitute the members forming the stitch, that is to say the points of the needles and the sinkers, are substantially identical in the present machine. In a specific but non-limiting manner, the solution chosen is that having fixed sinkers as in FIG. 20 of the prior patent (U.S. Pat. No. 7,689,971). The parts which differ in the present machine are:

1) the part of the needle (called the heel) which acts on the cams that provide its movement;

2) the means of selection of the needles, since particular oscillating selectors have been adopted, or alternatively a direct electronic selection system;

3) the selection control means, which are controlled by an electronic system with an electro-pneumatic servo-system;

4) the cams which act to raise and lower the needles for the formation of the stitch, since these are disposed in sets for two thread feeds and are all fixed on the respective continuously rotating apparatus, with the exception of the small upward movements of the stitching cams to regulate the length of the stitch;

5) the thread feed system.

As previously stated, the present machine is a circular machine of large diameter having a circumference such as to be able to accommodate a plurality of articles, such as pairs of tights, each having a body and two legs. In the description which follows the example taken —without limitation—will be that of a machine which simultaneously produces four garments, although embodiments can also be envisaged for the simultaneous production of a different, preferably even, number of articles.

In FIG. 2, C1-C2-C3-C4 designate the cross-sections of the bodies of the four pairs of tights, separated by empty spaces along the two circular needle bars which form them. FIG. 3 shows the cross-sections of the legs of the four pairs of tights, designated G1X, G1Y -G2X, G2Y-G3X, G3Y-G4X, G4Y, these also being separated by empty spaces. FIG. 3 shows, again diagrammatically, the four sets of cams generically designated 46, for the cylinder, drawn on the outside, and the four sets of cams generically designated 47 for the plate, drawn on the inside, carried by the two counter-rotating apparatuses 26 and 32. It may also be noted in FIG. 3 that the sets of cams are synchronized in their rotation, so as to cross in the empty spaces between one and another of the four garments. In FIG. 4 it can be seen that the sets of counter-rotating cams can also cross in the crotch zone during the manufacture of the legs, that is to say in the space between the legs G1X and G1Y, in the space between the legs G2X and G2Y, and so on, that is to say in the eight spaces visible in FIGS. 3 and 4. Therefore both the empty spaces which are between one pair of tights and another, and the crotch zone of each pair of tights, must have a circumferential aperture such as to contain the circumferential width of the double sets of cams 46 and 47, which are intended to control the needles of the bar forming the outer zones of the tubular articles being formed and, respectively, the bar forming the internal zone of said tubular articles. Each set 46 receives two feed threads, which pass to a set 47 and again to a set 46 and so on, to form successive half-rows with the needles of the bar of the cylinder and with those of the bar of the plate.

The garment which it is desired to manufacture is diagrammatically shown in FIGS. 14 and 15. Starting with the toes of the feet, these are formed by starting with closure rows A, C, D, B, comprising all the needles intended to form the leg, shown by the section G1X, G1Y, etc., in FIG. 3; immediately afterwards the toes are shaped with a profile such as to round the angles thereof. For this purpose, with particular reference to FIG. 15 and FIG. 16, a number of complete rows of stitches A, C, D, B are formed which are common to both bars (that is to say, are formed simultaneously with needles of the plate and with needles of the cylinder) to form the closure of the toes; these rows A, B, C, D go from A to B, that is to say they comprise all the needles intended to form the foot of the stocking and the ankle, and are made by supplying the thread simultaneously to the two bars, with the needles crossed as indicated in FIG. 16. Subsequently, rows P of tubular knitting are formed, that is to say first on one bar and then on the other, but these will be of short and gradually increasing length; a start will be made, for example, with the central section C-D of FIG. 15, the length of the successive rows (P) being increased at both ends in a symmetrical manner, the frequency of increment being selected as a function of the profile of the shape which it is desired to obtain. The result will thus be that the sections AC and DB assume a curvature of the type shown in FIGS. 14 and 15.

Subsequently, in the situation shown in FIGS. 3 and 4, a tubular section of constant width is made, which will form the foot part and the lower part of the leg; said section is shown by BE in FIG. 14. After this section, in order for the garment to be easily put on, it is necessary for the leg to be widened. This can be achieved along the section E-F in FIG. 14, the length of the stitches of the rows of knitting produced in this section being gradually increased; the widening may also; and more efficiently, be achieved if, in addition to what has been said, the number of needles at work is gradually and constantly increased during the formation of the section E, F, with successive insertions of needles at the ends of the working arcs of needles, on each of the two bars simultaneously or alternately. When the section EF has been completed on both legs, work proceeds from the situation in FIGS. 3 and 4 to that in FIGS. 2 and 17, two of the four feed groups 46 in the section of the cylinder and two of the four feed groups 47 in the section of the plate being withdrawn from operation; that is to say, work progresses from the state shown in FIG. 3 to that shown in FIG. 17. In this position, the needles which are between the two legs, that is to say the zone called the crotch of each garment, are introduced into operation, this zone being shown in FIGS. 14 and 17 by the section F-H. With the elimination cf two of the sets 46 and 47, the associated feeds are also withdrawn; there therefore remain only four of the eight feeds. Said needles of zones F-H are introduced all at once on each bar, alternating 1:1, and with the needles of the two bars being staggered and crossed (FIG. 16) to form, in the sections F-H, closure rows of the type described for the toes. Advantageously, it is possible to control, together with the needles of the section FH, also one or two contiguous needles of the faces which have prepared the legs; this avoids the formation of eyelets at the edges of the section FH. Thereafter, a tubular fabric is begun on the face K-L, that is to say, also comprising the needles which belong to the zones of the legs, producing a tube as wide as the entire garment and forming what is called the body. The body is shown in FIG. 14 by the section L-M. Thereafter, a finishing section, such as an elastic strip, is created in the section M-N; this strip may be formed by a double fabric 10 turned over on the line MM and obtained by knitting in or interweaving an elastic yarn of a rather high yarn count. The textile structure of this double border is already known to those skilled in the art.

In order to implement the rows of connecting stitches along the initial closure lines ACDB of the ends and along the lines F, H of the crotch with crossed needles 13 and 15 (FIG. 16) of the two bars 10 and 11, it is possible to adopt the method more specifically indicated below. By selecting 1:1, the needles 15 of the cylinder 11 are raised, no thread being supplied. This staggered relative to the needles 15A which remain raised, are progressively raised and lowered; and at the same time the thread taken from needles 13A is fed to form the stitches on the stems of the needles 15A, which are kept raised. Subsequently, the thread is supplied to the needles 15A, which are lowered to form a stitch. A subsequent row is then formed with the needles 13. This procedure may be repeated before formation of the tubular fabric begins.

The machine explained here, capable of producing four pairs of tights simultaneously, will be equipped with four sets of double feeds for the needles of the cylinder and with four sets for the needles of the plate, for a total of eight feeds in each case.

From FIG. 3—which shows the situation for the knitting of the legs—it is apparent that, from the initial position shown, after the sets of cams have completed ⅛ of a rotation (in opposite directions), the latter come to cross in the crotch zone of the garment as in FIG. 4. The abovementioned crossing is not possible when work is in progress on the knitting of the bodies, as shown in FIGS. 1 and 17, since needles are in operation in the crotch zone. It is for this reason that, for the formation of the body, the machine must operate with only two sets of cams for the cylinder and two sets for the plate, and hence with two feeding threads instead of with four for each of the garments being worked upon; the number of feeding and stitch-forming cams is thus reduced to four for the cylinder and to four for the plate, as shown in FIG. 17.

FIG. 5 shows the section of the bars of the present circular machine in the operating zone of the needles, and, more extensively, the section of the plate 10, while that of the cylinder 11 is shown only in the working zone; as already stated, the two bars form the grooves for the radial sliding of the needles 13 of the plate and the longitudinal grooves for the sliding of the needles 15 of the cylinder.

The needle 13 of the plate 10 is formed, in the part which acts on the thread, in a conventional manner, with beak and tongue; the stem of the needle, however, is different from traditional stems in that it possesses a protuberance 114 of circular profile. The protuberance 114 serves as a support and articulation for a small oscillating selector or jack 116, which, for this purpose, is provided in an intermediate position with a cavity 117 having the same circular profile and hence being able to engage with and oscillate upon the projection 114 of the body of the needle 13, needle 13 and jack 116 always remaining connected since they are held within the sliding channel of the needle. In its anterior part the oscillating jack 116 forms a heel 118, which is intended to act together with cams 120, 121, 122 for the centrifugal and centripetal radial control of the needle. The heel 118 is shown in FIG. 5 projecting in the active position 118X in order to be controlled by the cams 120, 122, and it can be pushed into, and hence completely countersunk in, the sliding channel of the needle by the action of a pusher strip 124 which acts on the upper edge of the heel, as a result of which the claws 120 and 122 do not act thereon. When the jack has oscillated and the heel 118 is projecting in position 118X, the cams 120 and 122 can act thereon, and by means of their profiles displace it in the centrifugal direction f13 or in the centripetal direction; with this movement imparted to the heel 118, by means of the connection on the pivot 114, the jack 116 also entrains with it the needle 13, producing the necessary travel for the gripping of the thread and the formation of the stitch. The unit formed by the needle 13 and the oscillating jack 116 can therefore be brought into operation or excluded, the heel 118 being raised or lowered by action in accordance with the arrow fA and with the arrow fB respectively. Exclusion, in accordance with fB, is achieved with the strip 124 sketched in FIG. 5 which acts when the needle is in a centripetally retracted (lowered) position of rest, to which it is restored by a cam such as the cam 122. The raising of the heel 118 by action in accordance with fA is implemented by selection members described hereinafter. The plate 10 (like the cylinder 11) is fixed, and the cams 120, 122 and the strip 124 are carried by the apparatus which rotates in continuous motion. The raising of the heel 118, as a result of control by cams such as the cams 120 and 122, is provided for by selection members consisting of other oscillating jacks 126, of the type having two rows of teeth, shown in FIG. 6. These jacks 126 are accommodated in grooves in the body 9 which is fixed to the plate 10 and are held there by springs 128 which permit them to oscillate about an intermediate bearing point. Each of the jacks 126, with its own heel 126A, can act in accordance with fA on the corresponding jack 116 in order to make the heel 118 project. Each jack 126, which is mounted perpendicularly to the jack 116, possesses two sets of selection teeth 126B and 126C, one above and the other below the bearing and oscillation point. The lower set of teeth 126C serves to activate the jack in that, as a result of pressure by means of selection levers on the present teeth 126C, the jack 126 enters into the lower part of the channel and leaves the upper part thereof, engaging with its own thrust heel 126D on the cam 130, which has a profile such as to lower the said jack to act in accordance with fA. The teeth 126B of the upper part serve only to make partial cancellations of selections previously made by acting on the teeth 126C of the lower part. The jacks 126 of the plate are seated in cuts made in the cylinder 9 which is superimposed on and fixed to said plate 10, as a result of which each jack 126 moves, when it is lowered, into a suitable position for pressing, in accordance with fA, on the radially inner part of the small oscillating jack 116.

A similar system is provided for selections in the cylinder 11, with oscillating selection jacks 132 mounted in the same plane as the needles 15 of the cylinder, to each of which there corresponds (as in the case of the needles 13) an oscillating jack 136 with heel 138, similar to the jack and heel 116, but mounted in the same groove as the needle 15 and the jack 132. Cams, such as the cams 140, 329, 381, interact with the heels of the jacks 136 for the purposes of raising and, respectively, lowering. The oscillating action of the jack 136 to make it project the heel 138 is achieved by sliding the jack 132 upwards, in accordance with fA1, as a result of which an inclined plane 132A of the jack 132 acts on the edge of the jack 136 when said jack 132 is raised, in accordance with fA1, from the position in which it is situated in FIG. 6 to the position in FIG. 7; for the selection of the jacks 132 (and hence of the needles 15), there are provided the two sets of teeth 132B and 132C, and a heel 132D on which a cam 144, similar to the cam 130, can act.

FIGS. 6 and 7 also show a number of groups of selection levers which are carried by the two counter-rotating apparatuses 26 and 32, and which act—in various circumferentially spaced positions, as stated below—on sets of teeth 126B, 126C, 132B, 132C for the purposes of selection; the groups of selection levers project from the respective mechanisms 148, 150, 152, 154, one of which—representing all—is illustrated in FIGS. 8 and 9, in order to act on oscillating jacks such as the jacks 126 and 132 to thrust them towards the inside of the respective sliding and oscillating channels.

FIG. 8 shows a plan view of a mechanism such as the mechanism 152, having a group of selection levers 217, in which a lever 217 is shown as it performs the action of thrusting the selectors 132 towards the bottom of the sliding channels in the cylinder 11. The levers 217 of the group of levers of the mechanism 152 are mounted on a pin 219 about which they can oscillate, being stressed by the springs 220; the whole is mounted on a support plate 221 which is fixed to the appropriate rotating apparatus which carries the cams for controlling the sliding of the selected needles; hence, the groups of selection levers 217 rotate within the cylinder, thus being capable of engaging all the selector jacks 132 (and analogously for the jacks 126). A series of triggers 222, stressed by springs 223, are also mounted on said plate 221 and act with one tooth in each case to engage the corresponding selection levers 217 when the latter are excluded, moving them away from the cylinder, by means of the action of a trigger 224 which can move the selection levers from the position shown in FIG. 8 to that shown in FIG. 9. The active position (FIG. 8) of the selection levers can be set by adjusting an eccentric paw 121A mounted on the plate 221.

The single or multiple means which control the selection levers of the mechanisms 148, 150, 152, 154 are means mounted on fixed supports 225 (cf. FIG. 9) combined with the arms 1F (FIG. 1) and acting on the triggers 122 which pass in front of them. These means comprise levers 226 oscillating about a pin 227, which levers, if selectively thrust in accordance with f228 as indicated in FIG. 9 towards the cylinder and towards the trajectory of the selection levers, can cause the respective levers 222 to rotate in a manner such as to release the selection levers 217. The latter, which are stressed by the springs 220, select the selectors 132. Clearly, the levers 226 are equal in number to the levers 217 (and this applies for all the mechanisms 148, 150, 152, 154) and in the same plane as the latter, in a manner such as to be able to act on each thereof. Each of the levers 226 is controlled by a pneumatic cylinder 228 which intervenes, via solenoid valves which in turn are excited by an electronic program, against the action of a spring 230. The profiles of the levers 226 ensure a gradual action on the appropriate triggers 222 for the release and activation of the selection levers 217.

In order to exclude selection levers, such as the levers 217, the trigger 224 is acted upon in accordance with f224, in a manner such as to couple the selection levers with the respective levers 222. In order to control the trigger 224, an arm 232 is provided which is held in a projecting position by a spring 234 but which can be selectively actuated by a strip 236 articulated at 238 to the fixed structure (such as the support 225) and pushed by a pneumatic actuator 240 similar to the actuator 228, against the action of an opposing spring.

The selection of the needles, by means of the small oscillating jacks 116 and 136, can also be achieved with other systems, described below.

Figure 10:
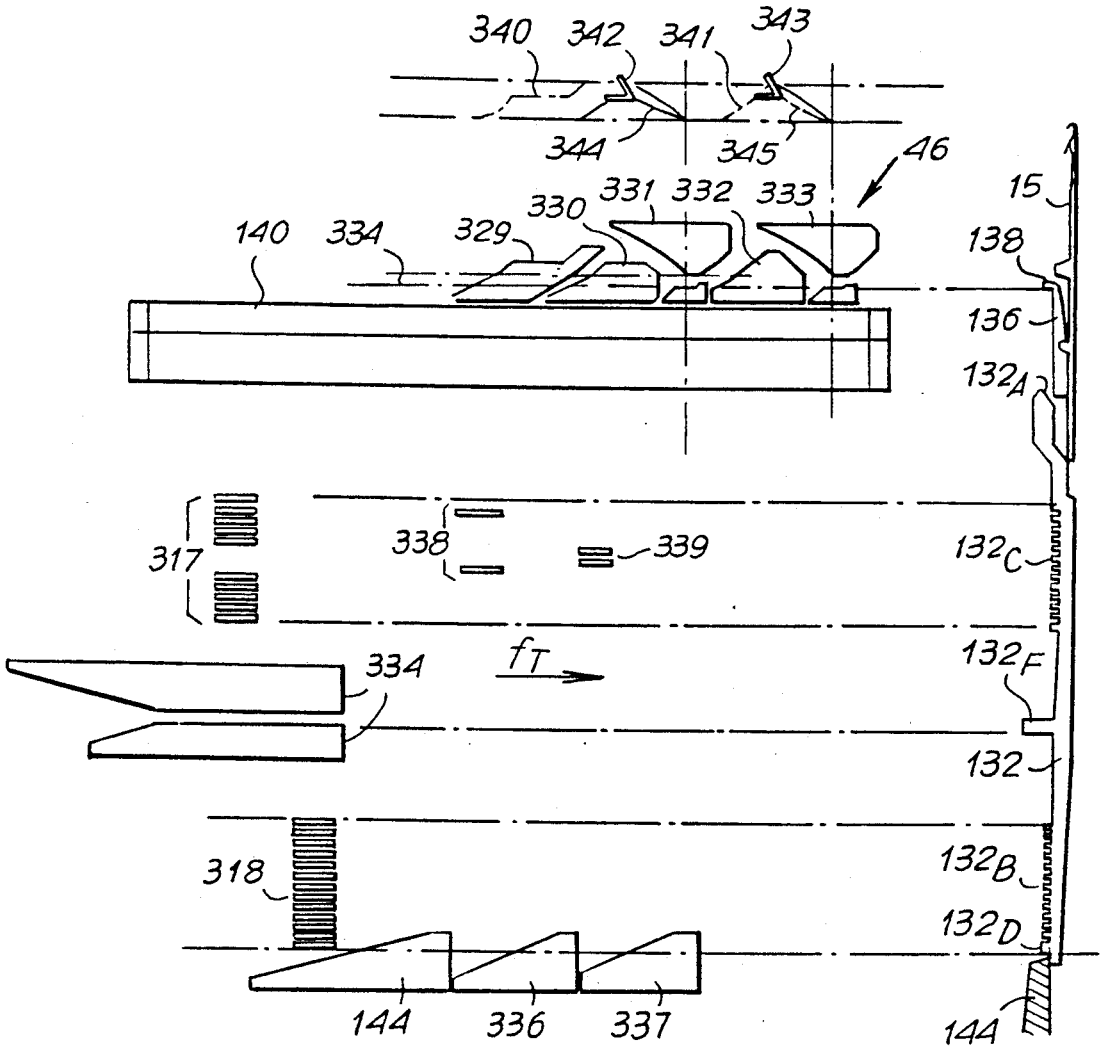

FIG. 10 shows a diagram with the development of the cams acting on the cylinders 132, 136 of the needles of the cylinder, in order to move the needles. The relative motion of the heels is shown by fT, but in practice it is the cams which slide in the opposite direction.

In the upper part are situated the cams which act on the heels 138 in order to raise and lower the needles 15, and in the lower part are situated the cams for the oscillating selectors 132.

The cams for the needles 329-330-331-332-333 act via the heel 138 of the small oscillating jack 136 only when the latter is rotated in a manner such that its heel 138 projects from the sliding channel of the needle and hence can engage with the abovementioned cams, along the line 334. When the heel 338 of the jack 336 is shielded in the sliding channel, it does not interact with the cams 329 to 333 and will remain at the level of the line 334, and the corresponding needle will remain lowered and will not grip thread. Oscillation of the jack 136 in order to cause the heel 138 to project—as stated above—is obtained by any raising of the selector 132, which is brought back into the lowered position by a double leveling cam 334 acting on a central heel 132F of the jack 132. The raising of the jack 132 takes place when the jack has been oscillated in a manner such as to have its lower part projecting from the cylinder, and hence the heel 132D can engage with said cam 144, or with other cams 336, 337. The cam 144, raising the selector 132, produces the rotation of the jack 136 and hence contact between its heel 138 and the cam 329, the consequence of which is the raising of the cam and of the corresponding needle. The cam 336 is able to bring about the raising of the needle with the cam 330. The cam 337 is able to bring about the raising of the needle with the cam 332. The selection levers (such as the levers 217 in FIGS. 8 and 9) capable of causing the selectors 132 to engage with the raising cams 144, 336, 337 are: the levers of the group 317 for the cam 144; the levers of the group 338 for the cam 336; the levers of the group 339 for the cam 337. The levers of the group 318 serve to exclude the jacks 132 from the active position.

The cams 329, 330, 331 for the needles of the cylinder form the first feed and are dependent upon the cams of the selectors 144 and 336 with the respective groups of levers 317, 318 and 338. The cams 332 and 333 for the needles of the cylinder form the second feed, and are dependent on the cam 337 with the group of levers 339. The cams 329, 330 and 332 are lifting cams, and the cams 331 and 333 are lowering cams for the formation of the stitches. The first and second feeds must be fed with two different threads, for normal working. Cams 329 and 331 are also shown in FIGS. 6 and 7.

In the upper part of FIG. 10 can be seen the profiles 340 and 341 which represent the travel of the point of the needles, when these are raised respectively by the cams 329 and 332, and lowered respectively by the cams 331 and 333.

The thread entrainment means are represented by hooks 342 and 343 for the first and second feeds respectively (with the relative movement of the heels and of the needles in accordance with fT, but in fact with a reverse movement of the cams). The broken lines 344 and 345 show the position of the threads fed to the needles by the thread-guide hooks 342 and 343.

Figure 11:
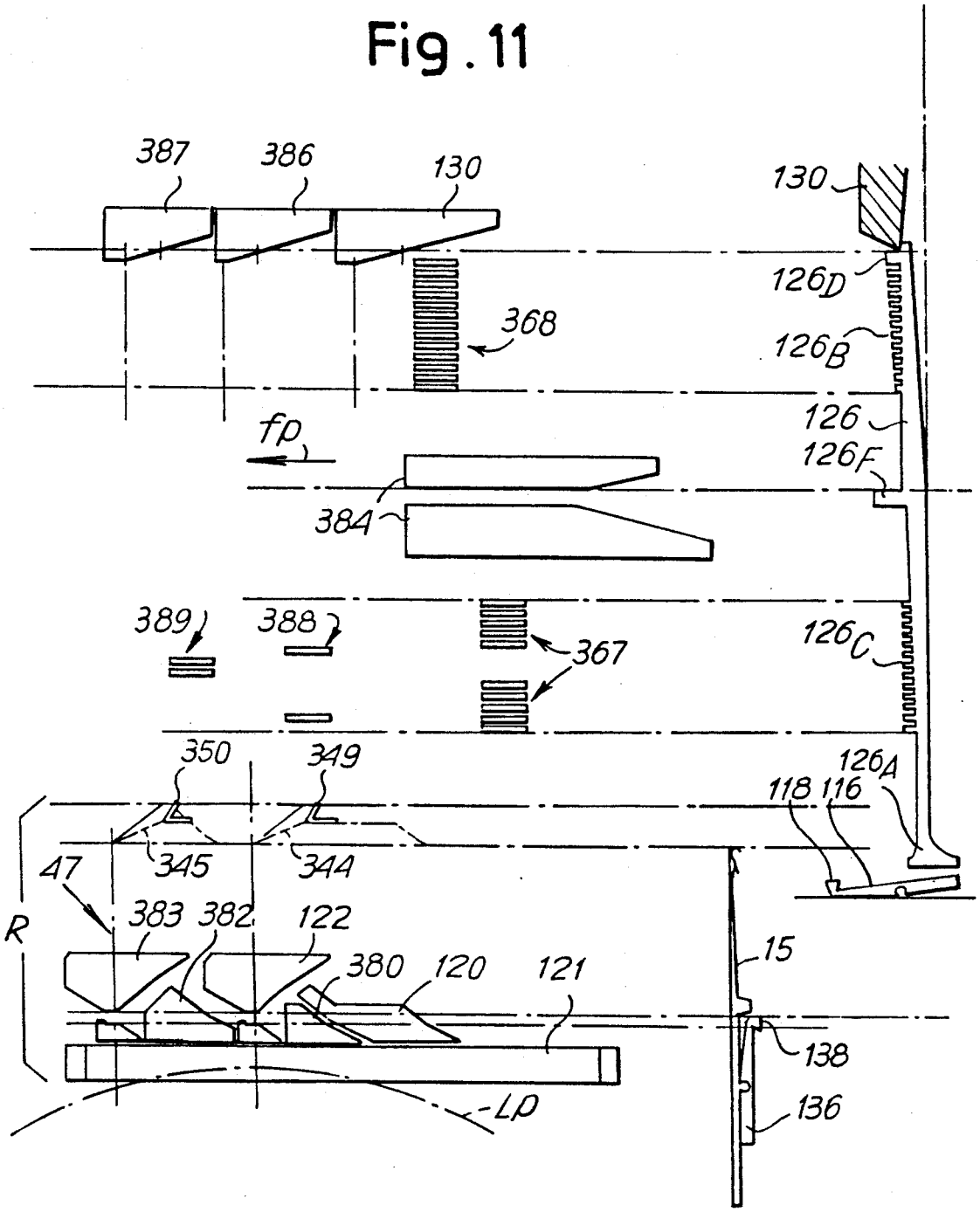

FIG. 11 shows a diagram of the development of the cams acting on the heels of the selectors 116, 126 for the needles 13 of the plate 10, analogously to FIG. 10, but with some of the parts, shown in zone R, in fact requiring to be rotated through 90°, the needles 13 being horizontal instead of vertical like the selectors 126; moreover their arrangement is in fact curved, as outlined by the line LP which indicates developments of the cams and of the circular trajectories about the center and axis of the plate. The top part of the diagram shows the cam 130 and those which act on the heels 126D of the selectors 126, to press them down, the assembly as a whole being inverted in that the selectors 126 have to be pushed downwards to act with the end 126A on the selector 116. The profiles 384 align the heels 126F and hence the selectors 126, which move in accordance with fP with respect to the cams (the cams, however, really being in motion in the reverse direction). The sets of triggers 368, 389, 388, 367 correspond in terms of function to the sets 318, 339, 338, 317. The cams 120, 122 (also illustrated in FIGS. 5 and 6), 380, 382, 383 correspond to the cams 329, 331, 330, 332, 333; a cam (120 or 382) is also shown at 120 in FIGS. 5 and 6. 349 and 350 designate feed hooks for the yarn, analogous to the hooks 342 and 343 and capable of catching the yarns previously entrained by the hooks 342 and 343 to present them in accordance with the lines 344 and 345. The passage of the yarns from one of the appropriate hooks to the other occurs in the manner described below, at the end of the formation of stitches with one bar and in order to start the formation of stitches with the other bar.

Apart from the different orientation of the parts in zone R, the diagram of FIG. 11 for the plate is entirely similar—including the functional aspect—to that of FIG. 10 relating to the cylinder.

The machine is equipped with double cam systems (329-331; 332-333; 120-122; 382-383) in order to move the needles on the two feeds, each of which has its own means of thread entrainment. These double systems can be converted to single systems, each representing a single feed, which supplies two threads of different yarn counts, in order to produce patterned knitted fabric of the type called "slip stitch" which is known in the art.

The present machine therefore has the capacity to process two different types of yarn on the components of two feeds, forming—on the two bars of needles—a fabric having two continuous helical rows intercalated one with the other; this serves to produce a product which is known in the art and comprises alternating rows of thread (of so-called Nylon) with a left-hand twist (S) and another thread with right-hand twist (Z). This capability is useful in order to make a second product, which is known in the art, comprising alternating rows of thread of untwisted Nylon and another of elastic thread such as that known as Lycra, or the like, an elasticized garment thus being obtained.

The machine, however, as mentioned, is also suitable for the knitting of another product which is known in the art, that having a patterned stitch with a slip-stitch pattern. This fabric is likewise produced using two threads, which in this case are of the same type (conventional Nylon), but of different yarn count. The pattern is obtained by supplying to the needles the two threads in the same feed, that is to say with a selective raising (by means of the selection cams 329 and the cams 332 for the remaining needles) and a single lowering (with the cams 333); hence the structure of the cams acting on the needles has to be slightly modified for the purpose. Since for each set of pairs of feeds of the type described initially there are two hooks 342-343 and 349-350 (one for each feed) for entraining and feeding the threads, it is necessary to use both of them to feed a single feed, that is to say to cause both the threads to be grasped by the needles with selective raisings and a single lowering of the needles.

This problem is solved by eliminating one of the two lowering cams, namely the stitch forming cams 331, 333, 122, 383, and thus converting each set to a single feed. The two cam arrangements initially described for the cylinder in FIG. 10 and for the plate in FIG. 11 will thus be modified as in FIG. 12 for the cylinder and FIG. 13 for the plate, in which the cams 331 and 122 respectively can be seen to have been eliminated.

It is known in the art how the slip-stitch pattern is produced, a thread of relatively high yarn count first being grasped by a number of needles, raised in accordance with a deliberate selection (which represents the pattern), and then, at a second, angularly delayed point, the other, finer thread will be grasped by all the needles. In the present machine this is achieved, with reference to FIG. 12, which shows the cams of the cylinder, by raising a number of needles, in accordance with the selection preselected on the cam 329, which needles describe the trajectory 340 and grasp the thread 344, while the remaining needles are raised with the cam 332 along the trajectory 341. The selection referred to above, which implements the desired pattern, is produced by the group of levers 317 or by the combination of the group of levers 317 and 318, which cause the selectors to rise on the cam 144 and consequently the needles on the cam 329. The remainder of the selectors rise on the cam 337 by means of a single lever of the set 339; in this case, a single lever is sufficient, since all the remaining selectors must be raised without any selection being necessary. The corresponding needles will rise on the cam 332, their points following the trajectory 341, and will grasp the thread 345. The thread 344 supplied first, and grasped by the needles first raised, will not be grasped by the needles raised subsequently, since the coarse thread will pass behind them, in accordance with a known method.

Figure 13:
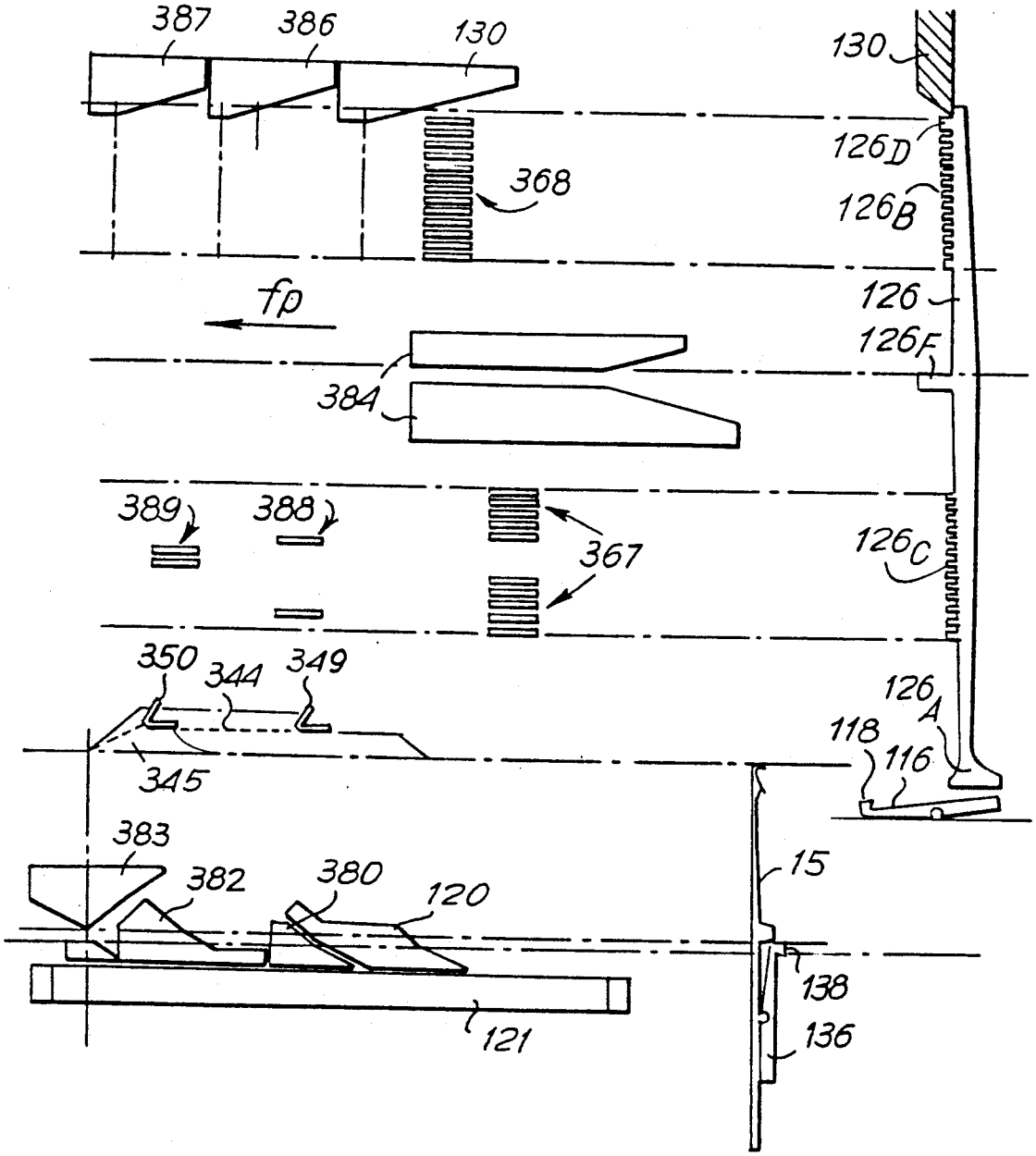

The formation of the pattern in the needle bar of the plate is entirely analogous to that described above for the cylinder, and the diagram for the cams is that of FIG. 13, where the absence of the cam 122 is apparent.

As already stated, the machine simultaneously produces a plurality of articles, in the present example four articles. When a thread breaks, in relation to an article being formed, continuation of the work is excluded in that zone of formation of the fabric, which can be achieved by virtue of the selection option offered by the mechanisms described. In particular, the outward movement of the heels 118 and 138 is excluded, and any damage to the tongues of the inactivated needles is avoided.

It is worthy of note that the arrangement described makes it possible to employ needles which are not directly provided with heels, while the heels 118 and 138 can be retracted in order to avoid any action on the needles. This prevents any stress on the stitches engaged by inactive needles, which undergo no residual lowering movement, the control cams for the needles, and specifically those for lowering the needles, remaining fixed. This arrangement avoids stress on the stitches and excludes the consequent risk of breakage of the thread, as well as avoiding the necessity of displaceable cams for the control of the needles.

In order to feed the threads, mobile entrainment means are provided which are connected to the counter-rotating apparatuses 26 and 32 of the cams of the cylinder and the cams of the plate. The thread is entrained in one direction by one of said means, which is activated, and is then released (when the latter is inactivated) in order to be entrained in the opposite direction by the other entrainment means, which in turn has been activated and arrives in the opposite direction. In this way—for each tubular article being formed—the alternating feed movement of the threads is achieved, in one direction for one bar and in the opposite direction for the other bar, without having any members which move with an alternating motion.

In the machine forming the subject of the present invention, the means of entraining the threads, that is to say the hooks in FIGS. 10 to 13, achieve said situation described above of avoiding the alternating motion with mechanical means. The design of said members is of a particular type, various sets of pairs of feeds being provided (see FIGS. 18 to 20) which are to supply mutually different yarns; therefore the entrainment means have to be capable of working in cooperation with other members for sorting the threads in order to ensure that the same thread is fed first to each bar, followed by the other thread, the direction of weaving being reversed on the two bars.

Figure 12:
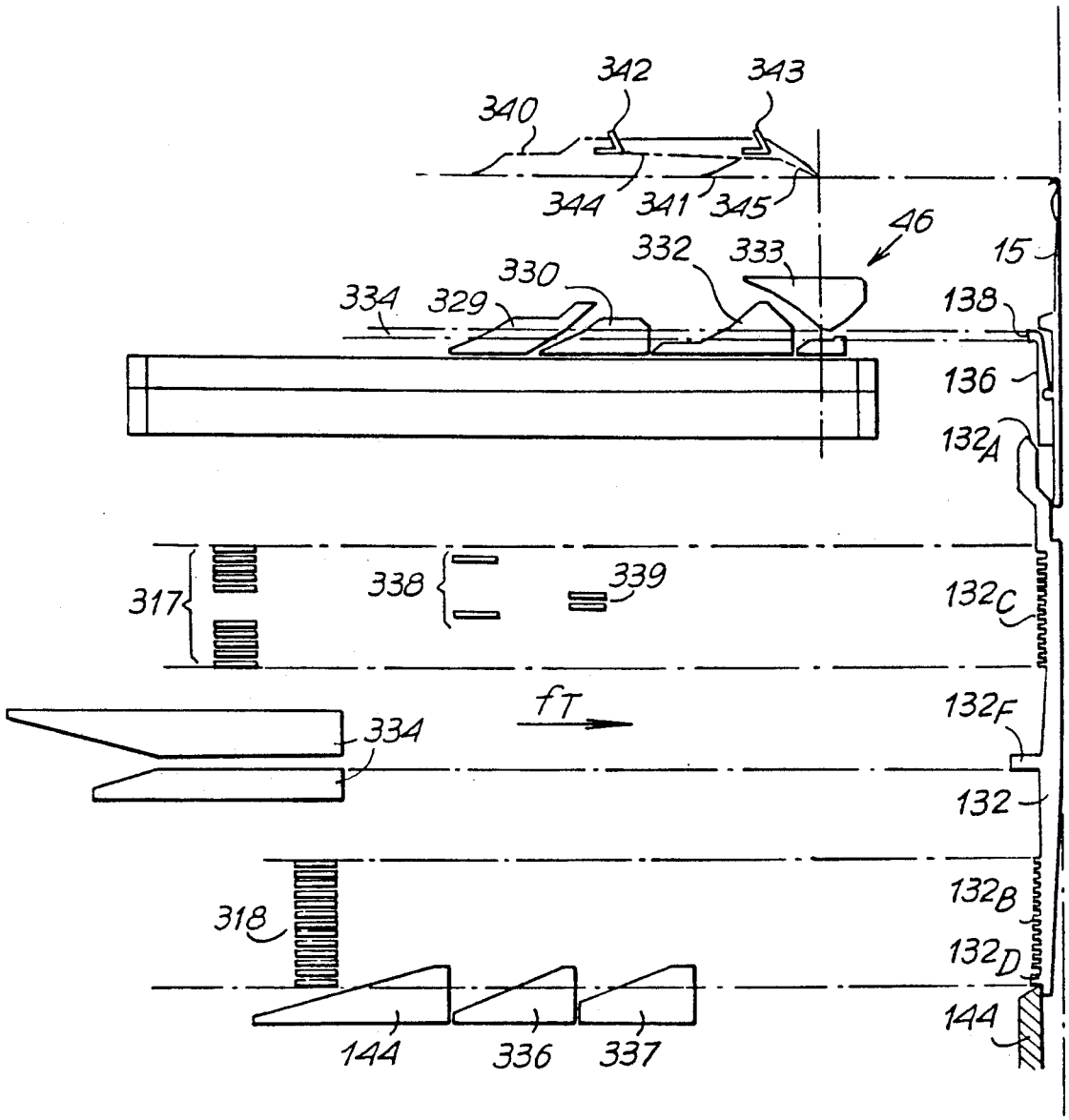

The part of the thread entrainment means which is in direct contact with said thread is a head formed in the shape of a hook which is designated with numbers 342 and 343 in FIGS. 10 and 12, respectively for the first of the two feeds and for the second, in the case of the cylinder. In FIGS. 11 and 13, 349 and 350 designate the hooks for the feeds of the same two yarns to the needles of the plate.

The structure of the thread-guide hooks and their orientation are indicated in FIG. 18 for the cylinder and FIG. 19 for the plate, in which figures it may be seen that the components which form them are the same, only the attitude of the sets varying. The sets comprise a stem 351 which can rotate on two small tushes 352; at one end of the stem is the thread-guide hook (for example the hook 343 for feeding the needles of the cylinder and the hook 350 for feeding the needles of the plate), while at the other end there is a crank 353 which serves to rotate the whole on the bushes 352, in order to cause the thread to be released by the hook, after which a restoring means returns the hook to the gripping position. Each of the release movements is effected by a fixed paw or profile with which the crank 353, carried by the rotating apparatus (26 or 32) of the appropriate cams, engages. The stems of the hooks 342 and 343 are external and approximately radial, whereas those of the hooks 349 and 350 are orthogonal to the plate. The two sets of hooks interfere neither with each other nor with the needles 13 and 15.

FIGS. 20A, 20B, 20C, 20D show various elements associated with the hook 343, in various views and in various positions. FIG. 20A shows an elevation and a plan view of the end of the hook 343, while the latter is in the normal position for entraining the thread. FIG. 20B shows an elevation and a plan view of the end of the crank 353 of said hook, while it is in the abovementioned position for feeding the thread. In FIG. 20C are drawings of the abovementioned hook while it is rotated to release the thread. In FIG. 20D are drawings of the crank of the hook in the rotated position for releasing the thread.

The rotation of the hook assembly is achieved by means of a cam such as the cam 354, which, with its inclined part, moves into the path of the crank 353 and encounters the latter during this transit in the direction f2 the entire rotating apparatus for the cams for needles and selectors of the appropriate bar. Cams of the type 354 are found at all the end extremities of the parts of fabric formed on the two bars at the points of passage between one bar and the other, in order to cause the thread to be released by the hook which has fed it to the needles of one bar, so that said thread can be collected by the arriving hook, on the counter-rotating apparatus for the opposite bar, in order to be entrained in the opposite direction and fed to the needles of said opposite bar. Restoring means cause the hooks to undergo displacements which are the opposite of those of the cams such as the cam 354; said restoring means may comprise opposing springs such as the spring 354, or cams acting on the cranks in the opposite direction to that brought about by the cams such as the cam 354.

FIG. 21 shows diagrammatically the positions indicative of the cams 354, 354' for the rotation of the hooks 342, 343 of the cylinder, while 355, 355, indicate the cams for the rotation of the hooks 349, 350 of the plate; the cams are carried by the fixed structure, such as the supports 1E, 1F. The cams designated 354' and 355' are those situated at the position of the crotch of the various garments; these are to be mounted on mobile supports so as to be able to be removed from the working position. What in fact occurs is that, when the transition takes place from working of the legs to working of the body, the thread must no longer be released at the points relating to the latter but must continue in order also to weave the crotch zone, and hence the whole body. The mobile supports can be radial slides controlled by pneumatic or electromagnetic actuators such as the actuator 354X (FIG. 20D), in order to remove the cams 354' and 355' from the trajectory of the respective cranks 353.

The two threads 344 and 345 of two contiguous feeds must always be gripped in a certain order by the two hooks 342 and 343, and similarly in the same order by the two hooks 349 and 350.

FIG. 22 and subsequent figures up to FIG. 30 illustrate the mode of operation of the hooks interacting with the cams of the cylinder in order to obtain the selection of the grip. The situation shown is that in which the threads 344 and 345 are at the left-hand end of the leg G1X (FIG. 3), as viewed from outside. The threads 344 and 345 which come from the bobbins are linked to the final stitch of the row of fabric just produced, and adhere to the edges of a ring 458, and also to certain protuberances 458A thereon; between two protuberances 458A is formed a depression 458C, each of which corresponds to the crotch zones between the two tubes of the legs, such as the tubes G1X, G1Y or the tubes G2X, G2Y. The spaces between two garments in simultaneous production, for example the space between G2Y and G1X in FIG. 24, correspond to narrower protuberances 458B. This ring 458 is fixed during operation.

The sliding contact of the threads (entrained by the hooks) with the ring 458, and hence with the protuberances 458A and the notches 458C, is a contact such that said threads assume two different attitudes, as in FIG. 22, with two different inclinations. More specifically, the thread 344 which is intended to be gripped by the thread-guide hook 342 of the first feed is more inclined, relative to the vertical, than the thread 345 which is intended for the hook of the second feed. It thus becomes possible to select said threads in a manner such that they are gripped by the appropriate hook, by means of these two inclinations. For this purpose, the hook 342 of the first feed is shaped in a manner such that its claw is inclined so as to guide only the thread 344 and avoid the thread 345; by contrast, the hook 343 of the second feed has the claw in a vertical plane, as shown in FIG. 22, and can guide the thread 345. In this manner the two feeds of the cylinder will be in operation, carrying the threads from the left-hand end to the right-hand end, as seen from outside.

When the threads arrive from the opposite side of the fabric, that is to say from the right-hand side of the leg G1X (as seen from outside), the situation appears as shown in FIG. 23, where it may be seen that the threads 344 and 345 coming from the bobbins and linked to the fabric still adhere to the ring 458, but have changed inclination, that is to say that the thread 344 is less inclined, relative to the vertical, and the thread 345 is more inclined. The threads are gripped by the feeds of the plate. For this purpose, the procedure is analogous to what has been stated above, the hook 349 of the first feed being shaped with an inclination such that it grips only the less inclined thread 344, avoiding the thread 345; the hook 350 of the second feed will be at an angle of approximately 90°, in order to be able to grip the thread 345.

Substantially, on condition that the threads 344 and 345 are exchanged in the two attitudes of FIGS. 22 and 23, the result achieved is that the thread 344 is always gripped by the first feed and the thread 345 is always gripped by the second feed. The attitude of the threads as described when they are on one side, and their exchanged attitude when they are on the opposite side, is obtained by means of the special conformation of the ring 458 and components associated therewith in order to switch the threads in that manner, during the interaction with the thread unwinding apparatus, and taking advantage of the alternating sliding of the threads caused by the successive and alternating intervention of the two pairs of hooks 342, 343 and 349, 350.

The hooks involved in the entrainment along the two bars combine to pass the threads during operation, and their only displacement is the rotational displacement in order to release the thread previously entrained and gripped at intervals by the hook which arrives in the opposite direction.

The ring 458, as a means of switching the threads of the two feeds, is a circular member having a relatively slight thickness and a profile as shown in the drawing, with the protuberances 458A and 458B already mentioned, and with the depression 458C. In the plan drawing, which for the sake of brevity represents only part of said ring, the positions of the garments to be produced are also indicated diagrammatically, specifically with G1X and G1Y designating the legs of a pair of tights with the associated intermediate zone of the crutch, and G2X and G2Y designating the legs of a second, contiguous pair of tights. In the leg, such as the leg G1X, TC designates the outer side woven by the needles of the cylinder, while TP designates the inner side woven by the needles of the plate. In line with the leg G1X (and with every other leg) is a protuberance 458A. Firmly fixed to the contiguous protuberance 458B is a steel guide wire 460 which extends towards the protuberance 458A along the periphery of the ring 458 as far as the abovementioned protuberance 458A; by contrast, a second guide wire 459, substantially symmetrical to the wire 460 relative to the protuberance 458A, is articulated at 461 in line with the contiguous zone 458A, and is displaceable in the manner and for the purposes described below. The two guide wires 460 and 459 in the plan view follow the external periphery of the ring 458 along the circumference which circumscribes the protuberances 458A and 458B; in the external view, however (see FIG. 25B), the two guide wires 459 and 460 are inclined upwards and towards one another, and do not cross one another. Adjacent to the pair of guide wires 460, 459 is an analogous pair of guide wires 471 and 472, the wire 471 articulated at 461A being symmetrical with the wire 459, and the wire 472 being fixed to the subsequent protuberance 458B; the two guide wires 471 and 472 are raised and convergent in line with the protuberance 458A contiguous with the depression 458C and in line with the leg G1Y. By means of actuators 462 and 462A, for example pneumatic actuators, the guide wires 459 and 471 can be moved away from their active position described above and rotated inward, as indicated in dot-and-dash lines, into a position of exclusion.

With reference to FIGS. 22 to 28, a plan view is shown of the positions of the threads 344 and 345, while the latter are situated on the left-hand side (as seen from outside) of the leg G1X and have just completed the knitting of the row on the section TP of the plate. Of these threads, the thread 345 is situated in the depression 458C and the thread 344 is projecting and more inclined (FIG. 24C); these threads are ready to be gripped by the hooks 342 and 343 of the cylinder (FIG. 22) and to move from left to right. The contact of the threads 344 and 345 with the ring 458 and its members occurs as is shown, in plan view, in FIGS. 24 and 24C. The thread 345 touches the ring as such at a point where the radius is reduced by the presence of the notch 458C, as a result of which this thread will assume a more vertical attitude with respect to the axis of the machine, in the section extending from the ring 458 to the needles, as is seen in FIG. 22. The thread 344 adheres to the protuberance formed by the guide wire 459, as a result of which the thread 344 assumes a more inclined path in the section extending from the ring to the needles. It is in this position (FIG. 24C) that the threads are situated in the conditions shown in FIG. 22 in order to be gripped by the hook 342 of the first feed and 343 of the second feed of the cylinder. At the opposite end of the working front of the leg G1X (FIGS. 24 and 24B) the two threads were parted, the thread 345 being in the external position and the thread 344 in the internal position (on the right as seen from outside). It is thus apparent that, when the two threads 344 and 345 travel from right to left in forming the fabric in the section TP, entrained by the hooks 349, 350 of the plate and having formed a stitch in the section TP, 344 must be passed from the initial, internal position into the external position on the steel wire 459, while the thread 345, having left the external position, must be carried to the more inward position on the reduced radius of the ring 458, within the notch 458C. This "internal/external" inversion of the two threads 344 and 345, and the way in which the threads can be passed into these positions, will become clear on examination of FIGS. 24, 24B, 24D and 24C and FIGS. 25, 25A, 25B, 25D (where the ring 458 is shown only in the portion corresponding to the leg G1X). It will be recalled that the guide wires 459 and 460 (FIG. 25A) do not follow the horizontal profile of the ring 458 but, in their part projecting towards the center of the protuberance 458A, these wires are raised, showing the two tips at a short distance apart and at a level above the ring 458; therefore, in the central zone of the protuberance 458A of the ring 458 (FIGS. 24, 24D, 25, 25D), where the radius is maximum, the steel guide wires 460 and 459 do not act upon the feed threads, their tips being at a distance from one another, and both the threads bear on the zone of the protuberance 458A. The feed threads 344 for the first feed and 345 for the second feed are entrained by the respective hooks 349 and 350 of the plate, and are situated at the center of their working section TP of the leg G1X. As can be seen in FIG. 25C, said threads, in the zone above the ring, assume different attitudes, specifically with 344 being inclined outwards and 345 being inclined inwards (the attainment of this attitude is explained below); this, in the second half of their movement from right to left, allows the thread 344 to be channeled by the outer side of the guide wire 459, and the thread 345 to be channeled on the inside of said guide wire 459. The result of this will be that, when the two threads 344 and 345 have arrived at the end of their travel through the section TP, they will assume the positions shown in FIG. 22 and 24C, with the thread 345 on the inside and almost vertical, and the thread 344 farther out and more inclined. In the return movement of the threads, from left to right, when the two threads 344 and 345 are entrained by the respective hooks 342 and 343 of the cylinder in order to form the fabric in the section TC, they will, on arrival in the central zone, necessarily have—above the ring 458—the attitude shown in FIGS. 24D and 25D, that is to say an attitude opposite to that shown in FIG. 25C, with the thread 344 inclined inwards and the thread 345 outwards, as a result of which the thread 344 will pass inside the guide wire 460 and the thread 345 will pass outside said guide wire 460 (in a manner analogous to that stated above). At the end of their rightward travel, the thread 344 will be disposed on the inside and the thread 345 on the outside, as in FIGS. 23, 24 and 24B, that is to say in the initial attitude described, in order to proceed to form a new row of stitches in the section TP.

A description now follows both of the feeding of the threads 344 and 345, and of the manner in which—by means of continuous movements and without accelerations or decelerations—said threads 344 and 345 can be caused to assume an attitude which is reversed from that with the thread 345 inside and the thread 344 outside to that with thread 345 outside and the thread 344 inside. This exchange must take place during each travel represented by the second part of the leftward displacement and by the first part of the rightward displacement, to achieve the attitude with the thread 345 outside and the thread 344 inside; the reversal again into the position with the thread 345 inside and the thread 344 outside must take place during the second part of the travel from left to right (knitting in TC) and the first part of the travel from right to left (knitting in TP).

The two threads 344 and 345 of each pair come from an unwinding apparatus, of which mention was made initially and which is substantially similar to that disclosed in the following patents and applications: Italian application No. 9527 A/85, filed on Nov. 28, 985; European application No. 86/830,356.1 of Nov. 8, 1986; Czechoslovakian application No. PV 8557-86 of Nov. 24, 1986; Japanese application No. 279,909/86 of Nov. 26, 1986; U.S. application No. 932,913 of Nov. 19, 1986, granted under No. 4,724,687 on Feb. 16, 1988. As many apparatuses will be provided as there are legs to be woven, that is to say eight in order to form—as in the example—four pairs of tights. All the unwinding apparatuses will be mounted on the abovementioned common annular support 40 which is capable of assuming two positions, as will be explained below.

An unwinding apparatus is shown in FIGS. 26 and 27, in a radial section passing through the plane of symmetry of the zone of formation of the leg G1X, and FIG. 28, in a diagrammatic plan view, indicates the position of said apparatuses relative to the ring 458 and to the working zones of the legs, during the production thereof. Each unwinding apparatus, generically designated 463 and carried by said support 40, rotates slowly about its own vertical axis passing approximately in the zone of the protuberance 458A, and completes a rotation during each complete cycle of forming a helically wound row along the section TC and TP in order to form the legs (and, subsequently, for the formation of the bodies also); in FIGS. 26 and 27 the orientation of the unwinding apparatus is shown as it is at the moment in which it is situated half-way along the working travel of the threads, that is to say with the threads 344 and 345 at the center of their working section for the legs G1X (FIGS. 25C, 24C) while they are moving entrained by the hooks 349 and 350 of the plate, from right to left, and are sliding on the protuberance 458A. The upward and outward inclined attitude of the thread 344 and the upward and inward inclined attitude of the thread 345 (necessary for them to pass respectively inside and outside the guide wire 459) is achieved by the relative position, relative to the ring 458, of two eyelets 465 and 466 (further described below) for the outward passage of the threads 344 and 345, which eyelets are shown as being instantaneously aligned radially, the eyelet 466 for the thread 344 being outside and the eyelet 465 for the thread 345 being inside relative to the external perimeter of the ring 458.

Each unwinding apparatus 463 comprises a rotatable plate 463A and a frame 463B which are fixed together; the plate 463A of each unwinder is carried, by means of a series of balls or other means of support, by the discoidal member 40 and is caused to rotate by means of a toothed belt from a toothed drive pulley 464, which is synchronized in a set—but changeable—relationship with the sets of counter-rotating cams for the movement of the needles. The rotating plate 463A is positioned with its axis approximately in line with the periphery of the ring 458 (FIG. 28); it supports below it, at the center, one B45 of the two bobbins B45 and B44 of the feed threads 345 and 344 respectively, disposed within the frame 463B. The thread 345 of the bobbin B45 is guided to an outlet eyelet 465, disposed on the periphery, in a position diametrally opposite to the eyelet 466, by which the thread 344 is guided. The plate 463A also carries a guide pipe 467 disposed towards the periphery and nevertheless eccentrically relative to the outside of the maximum bulk of the bobbin B45. A second bobbin B44 is disposed in any attitude on the discoidal member 40 which is mobile on the lattice structure of the machine, in the vicinity of the plate 463A, in a manner such that its thread 344 can be guided into the pipe 467. The pipe 467, together with the eyelet 466, causes the thread 344 to slide, guiding its trajectory within the bobbin B45. The position of the two threads 344 and 345, as illustrated in FIG. 26, is that which permits the thread 344 to be passed outside and the other thread 345 inside the steel guide wire 459. In FIG. 27, the unwinding apparatus 463 is rotated through 180°

(half-way through a cycle of knitting a wound row TC+TP) and the threads 344 and 345 have been exchanged in their inward and outward attitudes relative to the guide wire 460. In fact, when the feed threads 344 and 345 are moving entrained by the two thread-guide hooks 342, 343 of the cylinder, from left to right (as seen in the drawing) and are situated—as before—in the central zone of the leg G1X, the unwinding apparatus in question will have completed a rotation through 180°, as a result of which the thread 345 will be located radially outside and the thread 344 inside; when these reach the guide wire 460, the thread 345 will be held on the outside thereby, while the thread 344 will pass on the inside, as in FIGS. 25D and 24B. This achieves the object of always causing the thread 344 to be fed by the hooks 342 and 349 of the first feed, and the thread 345 by the hooks 343 and 350 of the second feed, both when the needles of the plate are working and when those of the cylinder are working, in a manner such as to create, with the two threads, two rows following two continuous helices in the fabric produced, and without crossing of the two threads in the passage between one bar and the other.

FIG. 28 shows a plan view of the relative position between the ring 458 and the various unwinders (of which only the profiles of the rotating plates, such as the plate 463A are indicated diagrammatically), one of which is the unwinder 463, while others are indicated by 474, 475, 476. The various apparatuses are positioned at the center of the working zone of the legs, and are provided on the basis of one for each of the latter; this is the situation during the formation of the fabrics of the legs. When the working of the legs is complete and working of the body begins, one of the two unwinders which have participated in the formation of the two legs of each pair of tights is retracted from the rotation, since its two threads are excluded from working, simultaneously with the exclusion of two of the four sets of cams 46 and 47 of the two bars. The unwinder which remains in operation, for example the unwinder of the leg G1X, will serve to feed the entire width of the pair of tights, comprising the leg G1X, the crotch and the leg G1Y. In order to close the crotch, the needles of the two bars are raised and crossed, in order to grip both the two threads being fed. At this point the two threads which formerly fed the leg G1X will have to slide over the entire width of the front G1 of the garment, that is to say along the front of the leg G1X, the crotch and the leg G1Y. In FIG. 28, 471 and 472 designate the two guide wires corresponding to the leg G1Y, the wire 471 being articulated at 461. With the elimination of two threads and the increase of the working front, as previously stated, the two guide wires 459 and 471 will have to be excluded, and this is arranged by means of the appropriate actuators such as the actuators 462, 462A which cause them to rotate inwards and hence to allow the threads to slide from one end to the other through an arc of about 90°, while the exchange of threads will be carried out by the two guide wires 460 and 472, in line with one of the two protuberances 458A corresponding to the article in question.

Simultaneously, it is expedient for the unwinder 463—which previously fed the formation of the leg G1X and is now to feed the threads for the entire width of the abovementioned front G1 of the body of the garment the—to be moved to the center of said front, relative to the body; this is achieved by means of the rotation of the discoidal member 40 which carries the set, for example with an actuator 477 which operates tangentially between the member 40 and the structure 1, 1C, in order to displace, in the abovementioned manner and for the abovementioned purpose, all the four unwinders which have remained in operation to the center of the crotch zone on the appropriate working front. There will thus be a transition from the situation shown in FIG. 28 to the situation shown in FIG. 29 which, for the sake of brevity, represents a situation of part of the machine, where the unwinders 463 and 475 are those which are active for the front G1 and G2, while the unwinders 474 and 476 are excluded and are no longer supplying thread.

The unwinding apparatus described above with reference to FIGS. 26 and 27 may also be modified in accordance with a slightly different embodiment, shown in FIGS. 30 and 31. In this embodiment, the rotation of the disk 463A and of the frame 463B does not impart a rotary movement to the bobbin B45. This makes it unnecessary to have to overcome the inertia of said bobbin at the instants when the machine is started and stopped; furthermore the rotation of the bobbin B45 is also prevented, when the machine is in motion, from transmitting vibrations owing to the fact that it may not be perfectly balanced on its axis during the delivery of its yarn. In this embodiment the bobbin B45 is mounted, at the center of the disk 463A, by means of bearings 478, and fixed to the core of the bobbin is a disk 479 of ferromagnetic material, having radial slots 479A. The rotation of the bobbin B45 is impeded—notwithstanding the rotation of the disk 463A—by a magnet 480, which induces a magnetic field in the sectored disk 479; the disk 479 is attracted by the magnet and hence braked; it can remain stationary since the bobbin B45 is not particularly urged to rotate, as a result of the presence of the ball bearings 478. The pipe 467 which guides the thread 344 from the bobbin B44 has to pass in the air gap between the magnet 480 and the periphery of the disk 479; the width of this air gap may in practice be very small, so as to ensure an adequate braking action.

The system of thread feed and feed interruption includes an assembly of pincers 483, each of which cuts and holds a thread when the latter is excluded from working. They also serve to present the thread for gripping by a thread-guide hook when said thread is to be introduced into the work.

Figure 32:
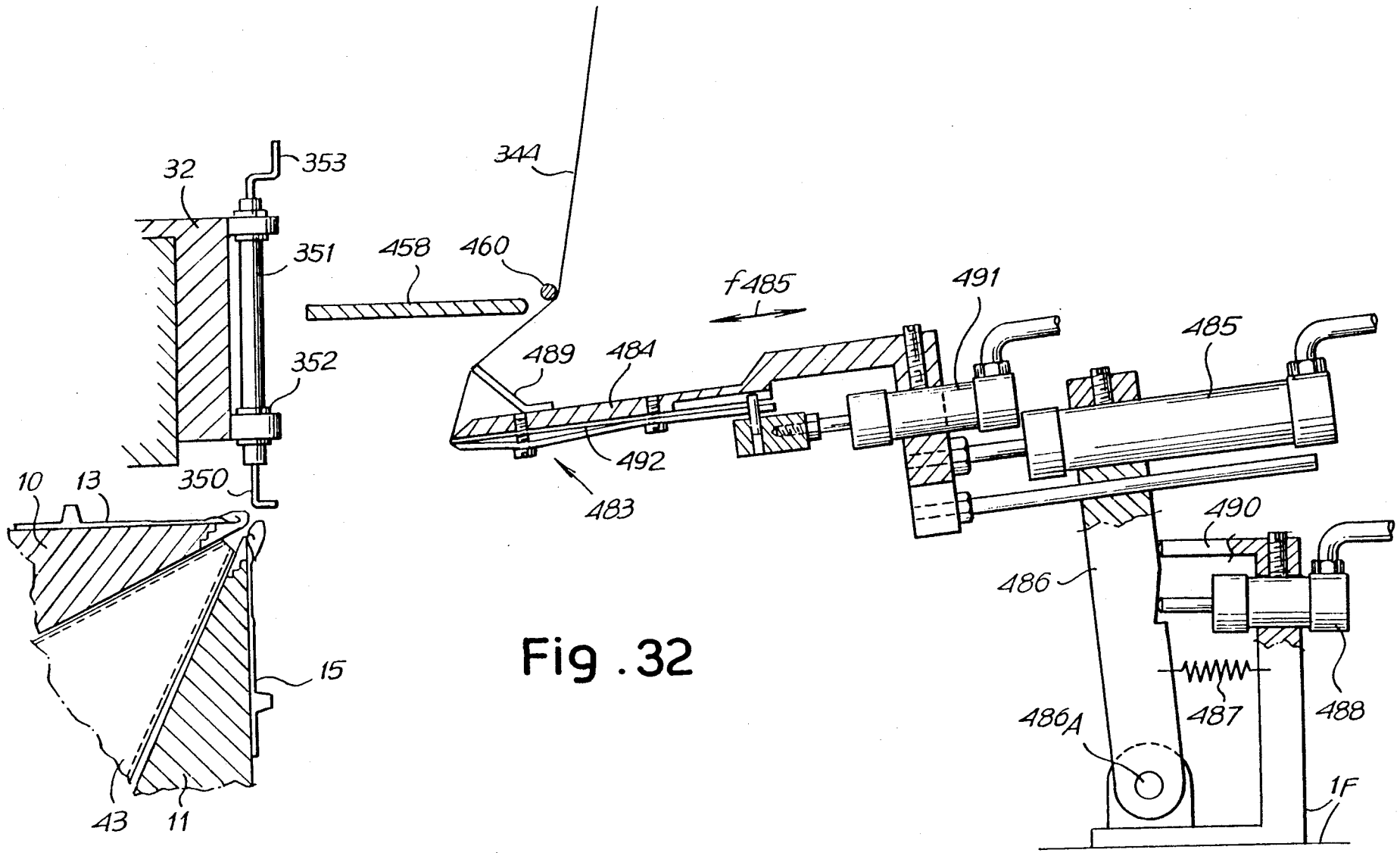
Figures 34, 35:
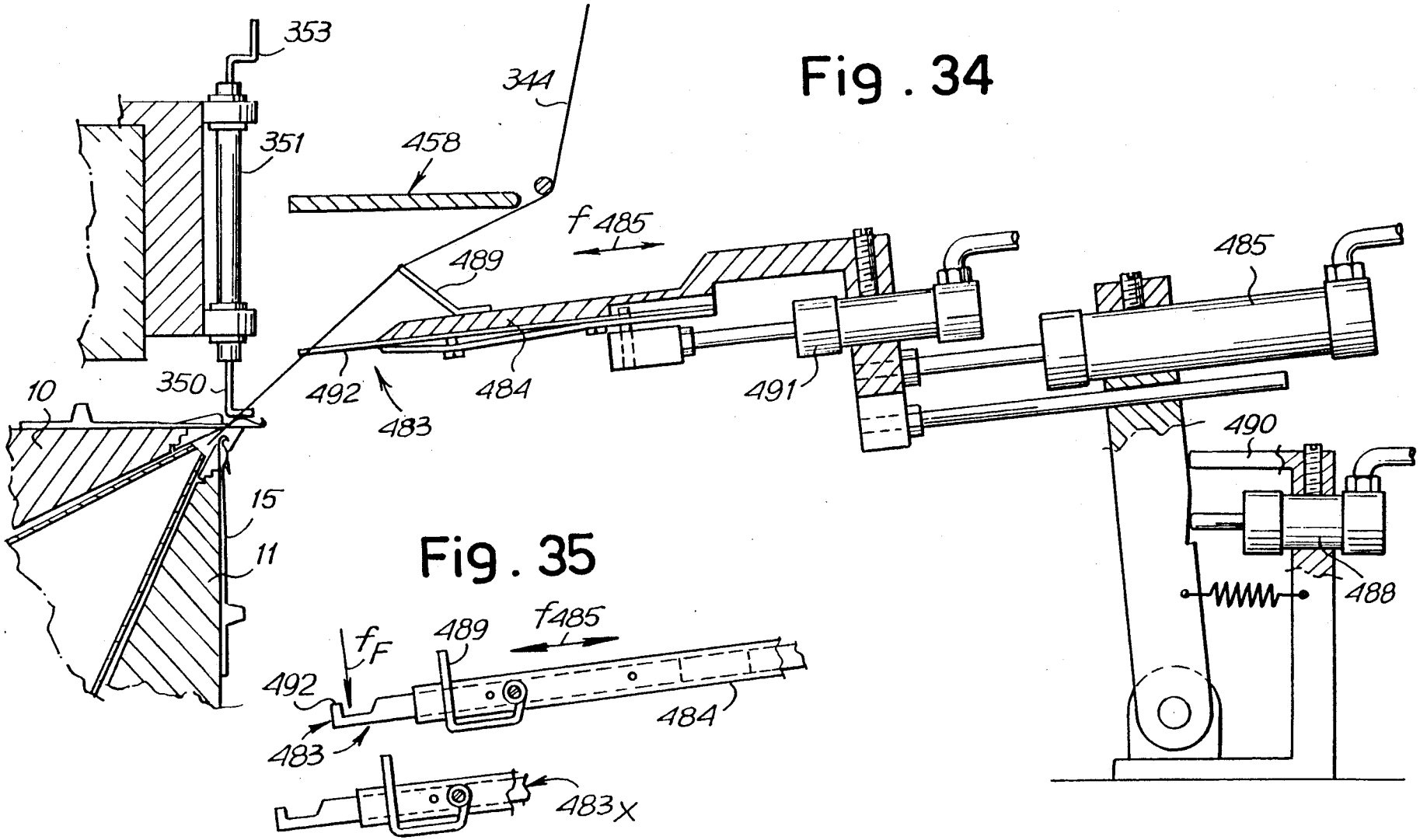

FIGS. 32 and 35 show one of these pincers 483, whose main body 484 is mounted at the end of the mobile apparatus of a pneumatic cylinder 485 which can displace said pincer forward and backward in accordance with the double arrow f485, in approximately centrifugal and centripetal directions relative to the axis of the machine. The pincers are indirectly supported by the fixed structure. The cylinder 485 is in turn mounted on an oscillating arm 486 articulated to the fixed structure at 486A, which arm is held in the position of rest by a traction spring 487, but can be caused to rotate towards the center of the machine when a pneumatic-cylinder actuator 488 is activated.

Figure 33:
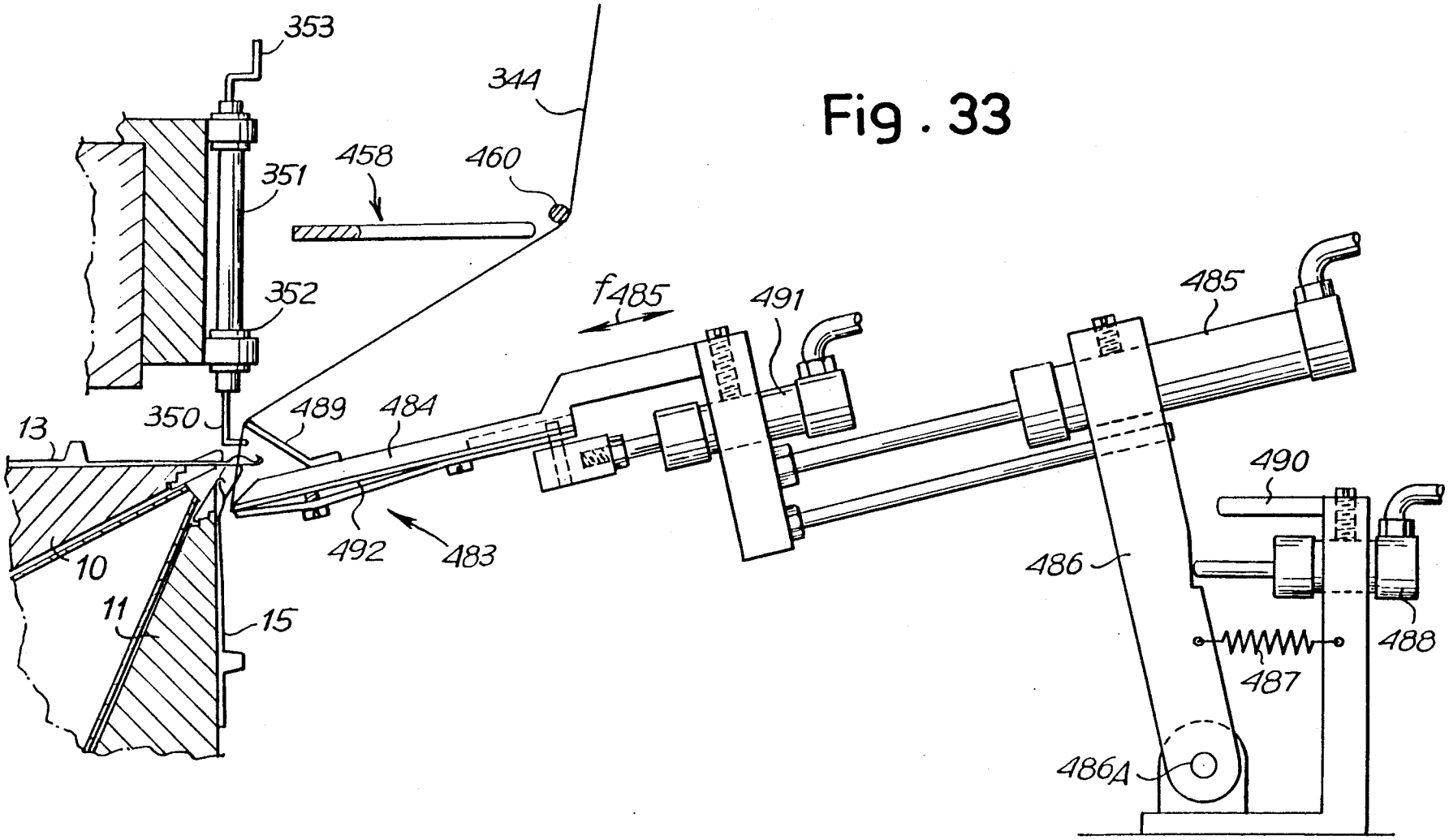

FIG. 32 shows the stage in which a pincer is holding the thread 344 when the latter is excluded from the work, and hence said pincer is in a retracted and raised position, defined by a stop 490, against which the arm 486 is caused to bear by the spring 487. FIG. 33 shows the same pincer in a centripetally advanced position and in the act of presenting the thread 344 to be gripped by the thread-guide hooks 349, 350 of the plate, and hence subsequently by the needles of the plate, while the hooks 342, 343 are not in transit. In this attitude, the pincer is also lowered by means of a pneumatic-cylinder actuator 488 and hence separated from the stop 490. Since the thread 344, intended to be gripped by the thread-guide hook, comes from the edge of a guide wire—such as the wire 460—and hence has a somewhat inclined attitude, gripping thereof can be facilitated by disposing an angle bracket 489 transversely on the upper part of the pincer, in a manner such as to position the thread more vertically; in practice, when the pincer 484 advances centripetally, the angle bracket encounters the thread in its path (see also FIG. 35) as shown in FIG. 33.

FIG. 34 shows the pincer 483 in a position which is only partly advanced, this being the thread-gripping position, when the thread is to be cut and held in order to be excluded from the work, that is to say in the position as shown in FIG. 32. In this position the pincer is raised and partly advanced, still controlled by the actuator comprising the pneumatic cylinder 485; moreover, the pincer is open, since its blade 492 is pushed out by the action of a pneumatic-cylinder actuator 491 carried by the body 484. The body 484 of the pincer and the associated blade 492 are better shown, in plan view and in the open position, in FIG. 35, which shows the active end of a further, contiguous pincer 483X intended to engage and cut the fed thread close to that grasped and cut by the pincer 483 which is illustrated in full. In FIG. 35, it may be noted that the blade 492 possesses a gripping and cutting recess facing the thread which is arriving in accordance with fF. When the thread is to be excluded from working, the pincer has to be brought into the position shown in FIG. 34 and has to be open, for which its blade 492—which is substantially hook-shaped —comes to be positioned in the path of the thread, which is entrained by the thread-guide hook 350 and can thus grip it and hence hold it and cut it, the reentry of the blade 492 being controlled and the pincer retracted into the position shown in FIG. 32.

In the thread release attitude (FIG. 33) the pincer holds the thread until it is secured by the first needles to which it is fed, after which the pincer releases the thread and again retracts.

FIG. 36 shows an alternative embodiment of the thread-guide hooks. Whereas, in the previous example, one hook (342 or 349) is bent at about 45° and the other (343 or 350) is bent at about 90°, according to the embodiment shown in FIG. 36 one hook 1342 and 1349 is bent at 90° and is short, while the other 1343 and 1350 is bent at 90° but is longer. With this arrangement, the short hook 1342 or 1349 grips only the first thread (that which is more inclined towards the stem of the hook) while the other, longer hook 1343 or 1350 grips the second thread (the thread which forms a greater angle with the stem of the hook). Otherwise, the preceding description applies.

FIG. 37 shows an alternative embodiment for moving the thread unwinders such as the unwinder 463. According to this embodiment, two thread unwinders such as the unwinders 1463 and 1474 or the unwinders 1475 and 1476 (equivalent to the unwinders 463 and 474 or 475 and 476) are mounted on a slide 1480 which can be slid in a virtually tangential direction indicated by the arrows fD. When one of the two unwinders (1474 or 1476) has to be taken out of operation and the other (1463 and 1475) has to be centered in the central position with respect to the working front of the body, it is sufficient to displace the pair of unwinders linearly in accordance with the arrow fD in order for the unwinder which is still active to move into the position 1463A and 1475A.

FIG. 38 shows an embodiment in which the member 458 is eliminated and unwinders 2463 (similar to the unwinder 463) are disposed to feed the threads directly to the hooks, which entrain them along the needle fronts; with the rotation of the unwinders, eyelets 2465 and 2466 (analogous to the eyelets 465 and 466) exchange, cyclically, the threads which are to be gripped by the hooks.

The program of the machine provides for variation of the working speeds in the various phases, and specifically a slowing-down when the ends are started, during the exclusion and insertion of feed threads, and in the act of formation of the crutch between the legs and the body.

As an alternative to what is envisaged in FIGS. 5 to 7, the selection of the needles—which is obtained by means of the oscillation of the small jack 116 or 136 mounted on the needle itself—instead of by the oscillating jacks 126 and 132 can be performed by other means of an electromagnetic type described hereinafter. FIG. 39 shows diagrammatically an example of a selection system in which each of the jacks 116 and 136 is caused to oscillate by its own trigger, which is moved by its own electromagnet; this in turn is activated by an electronic programmer which is synchronized with the rotation of the machine, i.e. of the two counter-rotating apparatuses carrying the sets of cams for displacing the needles.

In the case of the selection of the needles of the plate 10, the means for oscillating each jack 116 is a trigger 577 which also comprises the arm 577A and has as its fulcrum the round portion 578. The arm 577A can be attracted by the small magnet 580 as a function of the work cycle program in order to cause the entire trigger 577A-577 to pivot about the fulcrum 578. In this manner the arm 577 is lowered and presses down the tail of the jack 116 with the consequence of causing the heel 118 to emerge so as to cause the needle 13 to be actuated by the cams. The abovementioned triggers 577 are all mounted in the cuts on the periphery of a wheel 532 fixed to the plate 10, and are held by an elastic belt or spring 579.

Since the machine in question is designed principally for high degrees of fineness, and hence the distance between the needles is small, the room available for the electromagnets 580 is also small, and these could never—in view of their thickness—be accommodated between one needle and another. It will therefore be expedient to stagger them over two or more raws, as shown in FIG. 39. The triggers 577 will therefore be of two or more types, having arms 577A of different orientation; in the example of FIG. 39 a trigger 577, having the arm 577B for an electromagnet 581 will be inserted between two triggers 577 having an arm 577A for a respective magnet 580.

An analogous solution is adopted for the selection of the needles 15 of the cylinder 11, where a trigger 583 is able to depress the jack 136 and may have the arm 583A, and alternates with another trigger having the arm 583B, in order to cooperate with the respective electromagnets 585 and 586 disposed in two different ranks.

This selection system has the advantage—as compared with that initially described—of having a much more reduced bulk of the two counter-rotating apparatuses 26 and 32, this being limited merely to the cams acting upon the needles, without the selectors of FIGS. 8 and 9, The dimensions of the cylinder 11 and of the body 532 above the plate 10 are also reduced as compared with those of the cylinder 11 in the previous example and of the cylinder 9 above the plate. The part which relates to the selection of the needles is completely static, with the exception of the small oscillation of the triggers 577 and 583.

We claim:

1. A circular textile machine for simultaneously forming a plurality of tubular knitted articles, including shaped and finished articles, comprising: two fixed bars for knitting needles, a plurality of articles being simultaneously formed on individual arcs of needles facing each other on said two bars, each having rows constructed partly by the needles of one bar and partly by the needles of the other bar; two apparatuses rotating in continuous motion and in opposite directions, and one apparatus carrying control cams for the needles of one bar and another apparatus carrying control cams for the needles of the other bar; and, on each of said apparatuses, means for entraining yarn alternately in the two directions along the respective arc which is forming an article, the exchange of the yarn between the two counter-rotating entraining means taking place at working ends of the respective arc of needles; said machine wherein that, in order to obtain two successive yarn feeds for each working arc of needles and always having the same yarn fed first, in order to form rows of the continuous helical type: two successive yarn feeds (344, 345); means (458, 459, 460, 463) for guiding and switching the position of the two yarns in order to supply them to the needles at two angles and to exchange the yarn positions at each reversal of the entrainment thereof by the entraining means; as entraining means, pairs of hooks (342, 343; 349, 350) with the hooks of each pair being of said entraining means disposed one behind the other in the direction of the respective direction of advance, and a first hook (342; 349) being shaped so as to penetrate into a space between the two threads (344,345) to take only one thereof (344) and a second hook (343; 350) being shaped to take the other yarn (345); on said two counter-rotating apparatuses (26, 32) supports (352)for said hooks (342, 343; 349, 350) to permit the displacement thereof between an engagement position of the yarn and a release position of the thread; and, on the fixed structure (1, 1F), control means (354, 354'; 355, 355', 353A) for bringing about timely displacements of the hooks (342, 343; 349, 350) at the end of active travel along a working arc.

2. The machine as claimed in claim 1, wherein said hooks (342, 343; 349, 350; 1342, 1343; 1349, 1350) possess differently shaped active ends, are supported so as to be angularly mobile along axes orthogonal to the active ends, and possess cranks (353) interacting with active cam control means (354, 354,, 355, 355,) against the action of restoring means of spring type (353A) or cam type respectively.

3. The machine as claimed in claim 2, wherein one (342, 349) of said hooks (342, 343; 349, 350) is bent at about 45° to grip an anterior yarn and the second hook (343, 350) is bent at about 90° to grip the other yarn.

4. The machine as claimed in claim 2, wherein one (1342, 1349) of said hooks is shorter in order to grip the anterior yarn, and the other (1343, 1350) is longer in order to grip the other yarn.

5. The machine as claimed in claim 2, where the two bars of needles are on a cylinder (11) and on a plate (10), wherein the hooks (342, 343; 1342, 1343) for guiding the yarns to the needles (15) of the cylinder (11) are mobile along axes which are approximately radial to an outer circumference of the bar of the needles (15) of the cylinder (11); and wherein the hooks (349, 350; 1349, 1350) for guiding the yarns to the needles (13) of the plate (10) are mobile along axes approximately orthogonal to the plate (10) and above the bar of the needles (13) of the plate (10).

6. The machine as claimed in claim 1, wherein said switching and guide means comprise: a ring (458) having a shaped profile forming recesses (458C) and projections (458A), extending along the two bars; pairs of rigid guide wires (459, 460, etc.) disposed symmetrically on said ring having their free ends opposite and set at a limited distance relative to a projection 458A) of said ring and raised relative to said projection; and thread unwinding apparatuses (463), each combined with two bobbins (B44; B45) of yarn (344, 345,) and each comprising a rotating assembly (plate **463*a* and frame 463) having two outlet, eyelets (464, 465) which are offcenter relative to an axis of rotation, said axis passes approximately through a projecting zone (458A) of said ring (458) in order to obtain a cyclical displacement of the two yarns trajectory (344, 345) between said eyelets, and said projection and an exchange of the yarns which pass inside and outside the guide wires (459, 460, etc.) in the sliding of the yarns along said profile of the ring (458) under the action of the entrainment alternately effected by said hooks (342, 343, 349, 350**).

7. The machine as claimed in claim 1, wherein said switching and guide means comprise: thread unwinding apparatuses (463; 1463), each combined with two bobbins (B44; B45) of yarn (344, 345) and each comprising a rotating assembly (plate 463A and frame 463B) having two off-center outlet eyelets (465, 466; 1465, 1466); and means for causing the yarns to be engaged by the hooks of both pairs of said entraining means at the end of each entrainment travel and at each exchange of the yarns that pass inside and outside with respect to each other.

8. The machine as claimed in claim 7, wherein said means for causing the yarns to be engaged by the hooks comprise: a ring (458) having a shaped profile forming recesses (458C) and projections (458A), extending along the two bars; pairs of rigid guide wires (459, 460, etc.), disposed symmetrically on said ring, said wires having free ends opposite and set at a limited distance relative to a projection (458A) of said ring and raised relative to said projection; and apparatuses (463) having the a rotating assembly (plate 463A and frame 463B) having two outlet eyelets (464, 465) which are offcenter relative to an axis of rotation, said axis passes approximately the projecting zone (458A) of said ring (458) in order to obtain a cyclical displacement of the trajectory of the two yarns (344, 345) between said eyelets and said projection and the exchange of the yarns which pass inside and outside the guide, wires (459, 460, etc.) in sliding of the yarns along said profile of the ring (458) under the action of the entrainment alternately effected by said hooks (342, 343, 349, 350).

9. The machine as claimed in claim which comprises, for each yarn a pincer mechanism (483) capable of engaging and cutting the yarn (344, 345) to be excluded and presenting the cut yarn to be taken by the hooks (342, 343, 349, 350); means (485, 468A, 488) for displacing said pincer mechanisms and means (491) for controlling the engaging and cutting members thereof (484, 492).

10. The machine as claimed in claim 9, wherein said means (485, 486A, 488) comprise: a support having an oscillating arm (486) articulated on the fixed structure (1-1F), for the pincer mechanism( 484); an actuator (488) for displacing said arm support (486) in two active positions; an actuator (485) for causing the pincer mechanism (483) to slide relative to the arm support (486); and an actuator (491) for controlling the engagement members (484, 492) of the pincer.

11. The machine as claimed in claim 1, capable of forming garments with knitting of two tubular parts on two contiguous arcs of the two bars of needles (13, 15) and with subsequent weaving of a single tubular part as an extension of the two tubular parts and of a portion formed by needles of the needle zone comprised between those of said two contiguous arc which comprises: articulation means (461, 461A) for two guide wires (459, 471) attached to two contiguous pairs of said guide wires, said guide wires (459, 471) being situated in line with the needle zone comprised between those of the two contiguous arcs of the two tubular parts (G1X and G1Y) to be joined; and control means (462, 462A) for excluding said two guide wires (459, 471) from the active position and bringing them into active position in synchrony with the action of said pincer mechanisms (483).

12. The machine as claimed in claim 7, wherein said unwinding apparatuses (463, 474, 475, 476, etc.; 1463) are carried by mobile support members (40; 1480) in order for an unwinder always to be displaced into a substantially intermediate position with respect to the needle arc of the two bars fed by said unwinder.

13. The machine as claimed in claim 12, which comprises an annular member (40) that supports all said unwinding apparatuses (463) and is angularly displaceable on the fixed structure (1-1F); and an actuator (477) able to displace said annular member (40) in order to enable each unwinding apparatus (463), in the operating state, to reach a substantially intermediate position with respect to the needle arc of the two bars of said fed apparatus.

14. The machine as claimed in claim 12, wherein said support members are slides (1480) that are mobile on approximately tangential guides, each slide carries two unwinding apparatuses.

15. The machine as claimed in claim 1, which comprises sets (46, 47) of cams for controlling the needles of the various bars, each set comprises two cams (331, 333; 122; 383) for lowering the needles, one of the cams (331; 122) can be excluded, and subsequent raising cams (329, 330, 332; 120, 380, 382), to achieve: by including excludable cams (331; 122), the formation of two rows of stitches with the two yarns successively fed, and by excluding said excludable cams (331; 122), selection by means of advanced and delayed raising of the needles, thus forming a fabric having the design known as "slip stitch", with a single lowering and with formation of a single row of stitches.

16. The machine as claimed in claim 1, which comprises, for selective control of the needles, an electromagnet operating on each needle or selector thereof, said electromagnets being disposed in a plurality of ranks in order to increase space available for each electromagnet.

17. The machine according to claim 1, further comprising control means for controlling the needles of the two bars situated in the section for forming the crotch between the zones of the formation of the two legs at the start of the formation of the body such that they cross and form at least one closure row by two threads fed in the same manner as the threads fed for the formation of a leg.

18. The machine according to claim 17, wherein said control means raises at least one needle of each bar, in order to cross each other, which is contiguous to those of the crotch section, which is operated to form the legs, for reducing eyelets which would otherwise form in the article in the ends of the crotch closure zone.

* * * * *